US006248267B1

(12) United States Patent
Hosako et al.

(10) Patent No.: US 6,248,267 B1
(45) **Date of Patent: *Jun. 19, 2001**

(54) METHOD FOR MANUFACTURING FIBRIL SYSTEM FIBER

(75) Inventors: Yoshihiko Hosako; Teruyuki Yamada; Katsuhiko Shinada; Hideaki Habara; Shigeki Ogawa; Sadatoshi Nagamine, all of Otake; Keiji Hirota, Toyama; Takashi Kozakura, Otake, all of (JP)

(73) Assignee: Mitsubishi Rayon Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/141,032

(22) Filed: Aug. 27, 1998

(30) Foreign Application Priority Data

| | | |
|---|---|---|
| Mar. 6, 1996 | (JP) | 8-078374 |
| Apr. 1, 1996 | (JP) | 8-079189 |
| Apr. 15, 1996 | (JP) | 8-117065 |
| Apr. 22, 1996 | (JP) | 8-124009 |
| Nov. 14, 1996 | (JP) | 8-302922 |
| Dec. 5, 1996 | (JP) | 8-340543 |
| Dec. 12, 1996 | (JP) | 8-332386 |
| Mar. 4, 1997 | (JP) | PCT/JP97/00654 |

(51) Int. Cl.[7] ..... D01D 5/26; D01D 5/40
(52) U.S. Cl. ..... 264/11; 264/12; 264/517
(58) Field of Search ..... 428/359, 399; 264/11, 12, 178 F, 187, 200, 203, 517, 561

(56) References Cited

U.S. PATENT DOCUMENTS

| | | | | |
|---|---|---|---|---|
| 4,025,593 | | 5/1977 | Raganato et al. . | |
| 4,144,080 | | 3/1979 | McCorsley, III . | |
| 4,189,455 | | 2/1980 | Raganato et al. . | |
| 4,211,574 | | 7/1980 | McCorsley, III et al. . | |
| 4,426,228 | | 1/1984 | Brandner et al. . | |
| 4,483,947 | * | 11/1984 | Jakob et al. | 523/156 |
| 4,963,298 | | 10/1990 | Allen et al. . | |
| 5,022,964 | * | 6/1991 | Crane et al. | 162/146 |
| 5,268,414 | * | 12/1993 | Nakai et al. | 524/539 |
| 5,316,705 | * | 5/1994 | McNair et al. | 264/5 |
| 5,415,818 | | 5/1995 | Cloutier et al. . | |
| 5,434,002 | * | 7/1995 | Yoon et al. | 428/359 |
| 5,454,910 | * | 10/1995 | Yoon et al. | 428/359 |
| 5,589,264 | * | 12/1996 | Yoon et al. | 428/359 |
| 5,662,858 | | 9/1997 | Firgo et al. . | |
| 5,690,126 | * | 11/1997 | Matsumura | 131/343 |
| 5,695,695 | * | 12/1997 | Steinau et al. | 264/11 |
| 5,738,119 | * | 4/1998 | Edwards et al. | 131/331 |
| 5,863,652 | * | 1/1999 | Matsumura et al. | 428/359 |
| 5,891,532 | * | 4/1999 | Furuta et al. | 428/1 |
| 5,967,149 | * | 10/1999 | Tsugaya et al. | 131/332 |

FOREIGN PATENT DOCUMENTS

| | | |
|---|---|---|
| 1020719 | 11/1977 | (CA) . |
| 685944A5 | 11/1995 | (CH) . |
| 2326837 | 11/1973 | (DE) . |
| 381206B1 | 8/1990 | (EP) . |
| 533005A3 | 3/1993 | (EP) . |
| 2189541 | 5/1973 | (FR) . |
| 35-11851 | 8/1960 | (JP) . |
| 40-28125 | 12/1965 | (JP) . |
| 41-06215 | 4/1966 | (JP) . |
| 48-01416 | 1/1973 | (JP) . |
| 49-47609 | 5/1974 | (JP) . |
| 50-38720 | 12/1975 | (JP) . |
| 51-19490 | 2/1976 | (JP) . |
| 52-18291 | 5/1977 | (JP) . |
| 54-39500 | 11/1979 | (JP) . |
| 55-41691 | 10/1980 | (JP) . |
| 55-41693 | 10/1980 | (JP) . |
| 55-46162 | 11/1980 | (JP) . |
| 61-12912 | 1/1986 | (JP) . |
| 2-234909 | 9/1990 | (JP) . |
| 3-29819 | 4/1991 | (JP) . |
| 3-104915 | 5/1991 | (JP) . |
| 3-130410 | 6/1991 | (JP) . |
| 3-130411 | 6/1991 | (JP) . |
| 6-207309 | 7/1994 | (JP) . |
| 7 197314 | 8/1995 | (JP) . |
| 7-197314 | 8/1995 | (JP) . |
| 7-508320 | 9/1995 | (JP) . |
| 97/33018 | 9/1997 | (WO) . |

OTHER PUBLICATIONS

"Characteristics and Application of Microfibrillated Cellulose", SEN–1 Gakkaishi (SEN–1 To Kogyo) vol. 48, No. 10, pp. 42–45; Jul. 17, 1992.

* cited by examiner

*Primary Examiner*—Leo B. Tentoni
(74) *Attorney, Agent, or Firm*—Pillsbury Winthrop LLP

(57) ABSTRACT

The present invention provides fibril system fibers which may be employed in filter applications and in artificial leather applications, and also provides an industrially superior manufacturing method for such fibril system fibers, and a spinning nozzle. The fibril fibers of the present invention include at least one macromolecular polymer having a film forming ability, and they have a structure in which fibrillated fibers having a diameter of 10 micrometers or less branch from main fibers having a width within a range of 0.1 micrometers–500 micrometers, and a length within a range of 10 micrometers–10 cm.

9 Claims, 16 Drawing Sheets

METHOD FOR MANUFACTURING FIBRIL SYSTEM FIBER

This is a Continuation of International Appln. No. PCT/JP97/00654 filed Mar. 4,1997 which designated the U.S.

TECHNICAL FIELD

The present invention relates to discontinuous fibrillated fibers from a polymer solution in which macromolecular polymers having a film forming capacity are dissolved in a solvent, to surface-fibrillated fibers, and to split fibers containing fibrils and fibril fibers comprising such fibers. Furthermore, the present invention relates to a manufacturing method for fibril fibers and to a spinning nozzle which is preferentially employed in the manufacture thereof.

BACKGROUND ART

Discontinuous fibrillated fibers are preferentially employed as a raw material for obtaining threads or sheet-form material such as non-woven cloth or the like: such fibers are represented by pulp. Recently, in fields requiring a high filtration ability with low pressure loss, such as air filters and the like, the effective use of extremely thin fibers having a large surface area has been required. The use of fibrillated fibers has been proposed to increase the surface area and raise the filtration efficiency.

A large number of manufacturing methods for discontinuous fibrillated fibers used as materials in non-woven cloth, paper, and the like, have been known.

For example, in Japanese Patent Application, Second Publication No. Sho 35-11851, a method is discussed in which, when a polymer solution is discharged into a coagulation bath, and the polymer is precipitated and coagulated, the polymer granules, which are in a swollen state, or the fibrous materials, which are in a swollen state, are subjected to deformation or beating by means of appropriate shearing action, and thereby, a pulp material containing fibrillated fibers is obtained. The use of high speed agitation using an agitator having an angle at the rotational surface of a paddle or a blade, or alternatively, the discharge of the polymer solution and air simultaneously into the coagulation bath from a two-fluid nozzle, are disclosed as methods for applying shear.

However, the pulp material obtained by means of such a method is in a fibrillar shape having a plurality of tentacle-shaped projections, the smallest dimension of which does not exceed 10 microns, or is in a thin film shape or a ribbon shape, so that the shape thereof is insufficiently controlled as a fibrillated fiber structure.

The flash spinning method disclosed in Japanese Patent Application, First Publication No. Sho 40-28125 and in Japanese Patent Application, First Publication No. Sho 41-6215, is known as a method for producing continuous fibers (plexifilaments) of a large number of fibrillated fibers.

In this spinning method, a crystalline polymer solution which is at a temperature higher than the standard boiling point of the solution and in the spontaneous vapor pressure region or at a pressure higher than this is extruded into a low pressure region from an appropriately shaped orifice, and thereby, the solvent volatilizes violently, and the majority of the extruded polymers are torn, and thereby, continuous fibrillated fibers are formed. This method requires the instantaneous volatilization of the solvent, so that it is necessary to employ a solvent having a comparatively low boiling point, for example, benzene, toluene, cyclohexane, methylene chloride, or the like, and furthermore, it is necessary to select a polymer which forms a uniform solution in the solvent employed under high temperature and high pressure conditions, and which, moreover, is not soluble in this solvent when extruded into a low pressure region, so that the composition of the fibrillated fibers obtained is limited.

Furthermore, this method involves the use of low boiling point solvents, and the maintenance of high pressure and high temperature states, so that it is not industrially advantageous. Furthermore, the fibers obtained are plexifilaments, and it is difficult to form discontinuous fibrillated fibers using such a method.

Improvements to the flash spinning technology which serve as methods for producing discontinuous fibers are disclosed in Japanese Patent Application, Second Publication No. Sho 48-1416, Japanese Patent Application, Second Publication No. Sho 54-39500, and Japanese Patent Application, First Publication No. Hei 6-207309.

A method for obtaining fibrillated fibers by extruding an aqueous dispersion solution, obtained by dispersing a molten polymer in a large amount of water, together with additional water into a low pressure region is disclosed in Japanese Patent Application, Second Publication No. Sho 48-1416.

However, in this method, it is necessary to employ an extruder having a special structure because the polymer is dispersed in a large amount of water, and this can not be accomplished easily.

A method for obtaining discontinuous fibrillated fibers, in which continuous fibrillated fibers are obtained by the sudden lowering of pressure on a mixture of two-liquids, a molten polymer, and a solvent, these are torn by means of a water vapor flow, and the fibers are thus torn, is disclosed in Japanese Patent Application, Second Publication No. Sho 54-39500. A method is disclosed in Japanese Patent Application, First Publication No. Hei 6-207309 in which an inert fluid is brought into contact with flash-spun fibers, and by means of the appropriate adjustment of the volumetric flow rate of the inert fluid and the solvent vapor, discontinuity is achieved.

However, these methods also involve high-pressure operations.

A method which serves to reduce these high pressures is disclosed in Japanese Patent Application, First Publication No. Sho 51-19490; in this method, a solution of a thermoplastic polymer and a solvent is formed at a pressure below the critical solution pressure and a temperature below the low temperature critical solution temperature, and an emulsion employing this solution as a dispersoid and water as a dispersant is sprayed into a low pressure region together with a pressurized gas using a two-fluid nozzle.

However, although the pressure is lower in this method, it is still necessary to maintain the emulsion at a pressure within a range of 10–20 atmospheres.

A manufacturing method for pulp materials which does not require the use of high pressures has been disclosed in Japanese Patent Application, First Publication No. Sho 61-12912; in this method, an aromatic polyamide is dissolved in sulfolane, and this solution is dispersed using a high temperature gas under conditions generating high shearing forces. In this method, the use of a two-fluid nozzle, and the use of water as the high temperature gas, are proposed.

However, the viscosity of the polymer solution which is employed in this method is within a range of from 10 cP to $10^5$ cP, and this is low in comparison with the viscosity of polymer solutions employed in the wet spinning of common fibers, so that this method is difficult to use for widely used polymers. Furthermore, the substances obtained are in pulp form, and are not appropriate for use in non-woven cloths which are employed in filter applications and the like.

Furthermore, a method is disclosed in Japanese Patent Application, First Publication No. Hei 2-234909 for manufacturing sub-denier fibers from lyotropic liquid crystal polymers. In this method, an optically anisotropic polymer solution is extruded into a chamber, and in this chamber, a pressurized gas flows around the polymer and in contact therewith, and this moves in the direction of flow, and the polymer and the gas both pass through a gap into a low pressure region, and while thinning this flow, passage is conducted at a sufficient speed to split into fibers, and in this region, the split flow is brought into contact with a coagulating fluid.

However, in this method, it is necessary to pass a high viscosity polymer solution coming out of an extrusion port through a further gap, and blockage of the gap by the polymer solution is likely to occur, so that this method is not industrially advantageous.

A melt blown spinning method used in industry for polyester fibers and the like is a method for producing fibers on the submicron order. In this method, a polymer in a molten state which is extruded by an extruder is caused to lengthen, thin, and solidify in a high-speed gas flow, and submicron order fibers are obtained.

However, in this method, a thermally meltable polymer is a prerequisite, so that the method is not appropriate for use with polymers having a high melting temperature or polymers which are thermally deformable.

There is also a method in which islands-in-a-sea spinning of a polymer having two components having differing solution characteristics is conducted, and the island components are eluted, to produce ultrathin fibers.

However, in this method, after the fibers have been produced, it is necessary to elute the island components, and this is not economical. Furthermore, it is presently difficult to spin minute islands-in-a-sea type fibers using solution spinning, which is a spinning method for macromolecular substances which do not thermally melt.

In Japanese Patent Application, Second Publication No. Sho 52-18291, a method is disclosed in which a mixture comprising two or more thermoplastic resins which are hydrophobic and mutually insoluble, or this mixture with inorganic or organic material added thereto, is heated and melted, extruded through a slit nozzle, and after being drawn in one direction and formed into a band, the molecules whereof are oriented, chips obtained by cutting this band into lengths within a range of 3–50 mm are fibrillated by means of physical pressure, and by means of adding a water-soluble polymer, beating fibrillation is facilitated.

However, this method is applicable to thermoplastic resins; this method can not be applied to polymers such as cellulose, cellulose acetate, acrylonitrile polymers, and the like, which have a comparatively high melting point, are subject to thermal deformation, and are difficult to place in a molten state.

Solution spinning is used a manufacturing method for fibrillated fibers of polymers difficult to place in a molten state. In Japanese Patent Application, First Publication No. Hei 3-130411, which discloses a method for obtaining submicron order fibers of a polymer using this solution spinning, an ultrathin fiber having a diameter of 2 micrometer or less and an aspect ratio of 1,000 or more which comprises a polymer consisting of 85% or more acrylonitrile is disclosed. The method disclosed is one in which a mixed solution of polymers having different solubilities is prepared, and this solution is made into fibers by a commonly known spinning method, and after this, one polymer is eluted to produce an ultrathin fiber.

However, as in the case of the islands-in-a-sea type fiber described above, a polymer must be removed by elution, so that this is not economical, and in consideration of present-day environmental problems, it is necessary to solve the problem of the recovery or disposal of the eluted polymer solution, so that this is not an industrially advantageous method.

A manufacturing method for acrylonitrile type pulp is disclosed in Japanese Patent Application, First Publication No. Hei 3-104915, in which a solution containing 3–10 weight percent of a polymer having an average molecular weight of 300,000 or above, chiefly consisting of acrylonitrile, is wet spun, and formed into a fiber having a large number of pores, and subsequently an acrylonitrile pulp having fibrils with a diameter of 0.5 micrometers or less is obtained by beating.

However, in this method, even after beating, only a portion becomes fibers having a diameter of 0.5 micrometers or less, and the basic fibers remain, so that such pulp is insufficient for uses such as filters and the like which require a high surface area. Furthermore, when used for artificial leather and the like, the basic fibers have a deleterious effect on the feel, and this is not desirable.

A method for obtaining fibers having a submicron order diameter comprising a cellulose system polymer is disclosed in "Seni to Kougyou," Volume 48, Number 10 (1992), in which cellulose fibers are beaten in a high-pressure homogenizer. This method takes advantage of the highly crystalline characteristics of cellulose, and beating of the cellulose fibers, the fibrillation of which has proceeded, is continued to a microfibril order.

However, this method requires the use of a special device for the beating, so that it is not broadly applicable. Furthermore, the method may be applied to cellulose; however, it is difficult to apply the method to cellulose acetate or acrylonitrile system polymers, which are useful macromolecules not subject to thermal melting.

DISCLOSURE OF INVENTION

The present invention provides fibril system fibers suitable for uses in filters and artificial leathers, and provides an industrially advantageous manufacturing method for such fibril system fibers. In other words, the present invention provides a manufacturing method which makes manufacturing under low temperature and low pressure conditions possible, and furthermore, is applicable to macromolecular polymers having a comparatively high glass transition temperature, which could not be used in conventional methods, and macromolecular polymers subject to thermal deformation.

Furthermore, the present invention provides a spinning nozzle which is optimal for use in the manufacture of such fibril system fibers.

The fibril system fibers of the present invention comprise: fibril system fibers comprising at least one type of macromolecular polymer having a film formation capacity, and having a structure in which fibrillated fibers having a diameter of 10 micrometers or less branch from main fibers having a width within a range of 0.1 micrometer–500 micrometers, and a length within a range of 10 micrometers–10 cm; or fibril system fibers in which fibrils having a diameter of 2 micrometers or less cover the entirety of the surface of main fibers along the fiber axial direction of the main fibers; or fibril system fibers comprising fibrils having a diameter of 2 micrometers or less, and split fibers having a diameter of 100 micrometers or less, and a variety of thicknesses in a non-stepped manner, and an aspect ratio (l/d) of 1,000 or more; or fibril system fibers having a diameter of 2 micrometers or less and an aspect ratio (l/d) of 1,000 or more, which are obtained by beating such fibers.

A polymer may be employed to obtain such fibril system fibers which contains, in addition to the macromolecular polymer having a film formation capacity, at least one other polymer which is soluble in the solvent of this polymer, or a polymer may be employed which contains at least 30 weight percent of a cellulose ester, or a polymer may be employed which contains at least 10 weight percent of an acrylonitrile system polymer, and contains a polymer other than an acrylonitrile system polymer which is soluble in the solvent of the acrylonitrile polymer.

In a manufacturing method for such fibers, a polymer solution, in which a macromolecular polymer having a film formation capacity is dissolved in a solvent, is passed through a spinneret orifice and is extruded into a mixing cell, while a coagulating agent fluid of this macromolecular polymer is simultaneously sprayed into the mixing cell so as to flow in the direction of discharge of the polymer solution, and the macromolecular polymer is coagulated within the mixing cell in a shearing flow, forming fibril system fibers, and these fibers are then extruded from the mixing cell together with the solvent and the coagulating agent fluid.

Furthermore, when the macromolecular polymer solution having a film formation capacity is discharged from the spinning discharge port, the coagulating agent of this polymer is sprayed from the coagulating agent fluid spray port at an angle of greater than 0° but less than 90° to the direction of discharge of the spinning liquid, and the polymer is coagulated in a shearing flow, and the coagulum which is formed is washed; the coagulating agent fluid may also be in a gas phase, or a mixed fluid of the fibers formed and a solvent and coagulating agent fluid may be sprayed into a coagulating agent, or a vapor may be used as the coagulating agent; in this way, there are a number of effective manufacturing techniques.

In the present invention, a spinning liquid in which a polymer containing at least 30 weight percent or more of cellulose ester is dissolved in a tertiary amine oxide, or a spinning liquid comprising two or more differing types of polymer solutions in which at least one type of soluble polymer in an acrylonitrile system polymer solvent and an acrylonitrile system polymer are dissolved, may be employed.

A spinning nozzle for fiber production which is provided with: a polymer discharge part having a polymer supply port to which a polymer solution is supplied, a polymer flow path which controls the direction of discharge of the polymer solution, and a polymer discharge port from which the polymer solution is discharged; and a coagulating agent spray part, which is provided with a coagulating agent supply port, to which the coagulating agent fluid is supplied, a coagulating agent flow path, which controls the spray angle of the coagulating agent fluid, and a coagulating agent spray port, from which the coagulating agent fluid is sprayed; and in which a mixing cell part is provided at the confluence of the polymer discharge port and the coagulating agent spray port, and wherein the mixing cell part has a length of at least 0.3 mm on the downstream side from the point of intersection of the central axis of the polymer flow path and the central axis of the coagulating agent flow path, may be employed as the spinning nozzle for production of a fibril system fiber. The spinning nozzle described above encompasses spinning nozzles in which the mixing cell part has a length of at least 10 mm on the downstream side from the point of intersection of the central axis of the polymer flow path and the central axis of the coagulating agent flow path, spinning nozzles in which the polymer discharge port is positioned on the upstream side of the point of intersection of the central axis of the polymer flow path and the coagulating agent flow path, as well as the nozzles for spinning fibers described above in which the angle θ formed by the central axis of the polymer flow path and the central axis of the coagulating agent flow path is greater than 0° but less than 90° with respect to the direction of discharge of the polymer.

BEST MODE FOR CARRYING OUT THE INVENTION

The fibril system fibers 5 referred to in the present invention are separated by the form thereof into "discontinuous fibrillated fibers", "surface-fibrillated fibers," and "split fibers containing fibrils."

Here, what is meant by "discontinuous fibrillated fibers" are fibers, and aggregates thereof, having a structure in which a large number of very thin fibers (fibrils B) comprising a thickness from the submicron order (approximately 0.01 microns) to the micron order (a few microns) and which serve to form a three-dimensional net-shaped texture, branch from main fibers A. Although no particular restrictions are made with respect to the length of main fibers A, this length is within a range of from a few microns (approximately 1 micron) to a few centimeters (approximately 10 cm). These fibril fibers provide a good form with respect to the structure obtained by means of the standard methods for non-woven cloths and synthetic paper.

Figure 1:
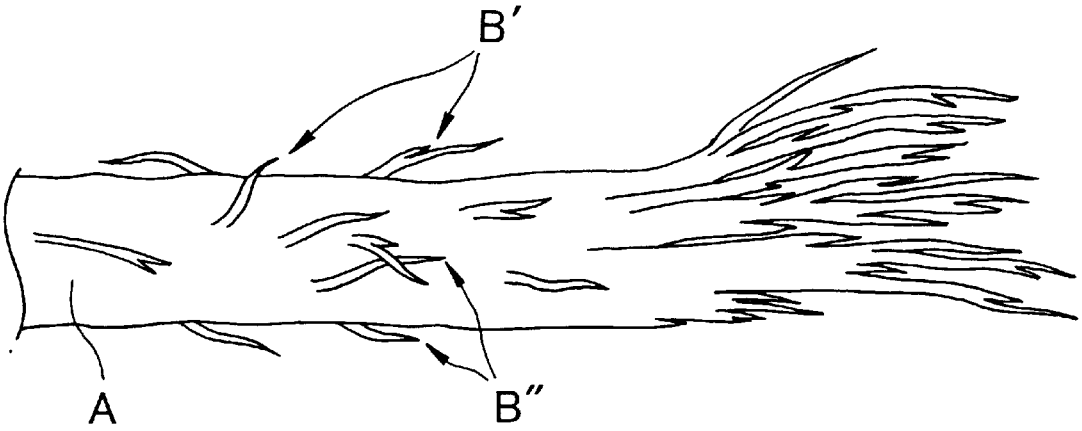
FIG. 1 shows a side view of a surface-fibrillated fiber in accordance with the present invention.

The "surface-fibrillated fibers" of the present invention comprise main fibers A and fibrils B, as in the case of the discontinuous fibrillated fibers. As shown in FIG. 1, the fibrils B' which branch from the surface of main fiber A, and/or the fibrils B", which are completely separated from the surface of main fiber A, cover the surface of main fiber A. Furthermore, as shown in FIG. 1, in the surface-fibrillated fiber of the present invention, the end portion and/or the central portion of the main fiber A may be split in a fibrillar shape.

Figure 2:
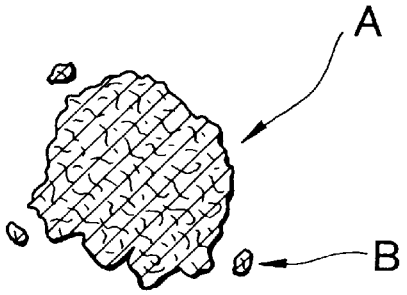
FIG. 2 shows a cross-sectional view, in a direction perpendicular to the axial direction, of the surface-fibrillated fibers of the present invention.

Here, what is meant by the fact that fibrils B having a diameter of 2 micrometers or less cover the surface of the main fiber along the axial direction of the main fiber A is that, as shown in FIG. 2, in a freely selected cross section taken at an angle perpendicular to the axis of the main fiber, the cross section of fibrils B can be observed outside the surface of the main fiber.

It is preferable that the observed proportion of the fibril cross section in a freely selected cross section taken at an angle perpendicular to the axis of the main fiber be 90% or more.

The main fiber A has a diameter within a range of 1 micrometer–100 micrometers, while fibrils B preferably have a diameter within a range of 0.1 micrometer–2 micrometers; fibrils B are layered in a straight or curved manner on the surface of main fiber A and along the axis thereof so as to cover the surface. Furthermore, most of these fibrils B themselves have a branching structure.

When such surface-fibrillated fibers having this structure are formed into a non-woven cloth, the branching fibers of less than 2 micrometers interact with one another, and it is thus not merely possible to add mechanical strength to the non-woven cloth, but also to increase the specific surface area, and to provide strong adsorption characteristics. Furthermore, the surface-fibrillated fibers may be cut to a prescribed length where necessary and spun, so that they may be used as a thread having a special feel of "sliminess".

Furthermore, this surface-fibrillated fiber may be used as a precursor fiber to the fibril-containing split fiber. In other words, this surface-fibrillated fiber, the precursor fiber, may be subjected to a mechanical load by means of a coagulation process, or may be subjected to beating treatment, and it is thus possible to obtain fibers having a wide variety of diameters in a non-stepped manner.

In other words, this results in fibril-containing split fibers which are produced from fibrils having a diameter of 2 micrometers or less and split fibers having a wide variety of diameters of 100 micrometers or less and having an aspect ratio (l/d) of 1000 or more. Here, l indicates the fiber length, while d indicates the apparent diameter of the fibers. The fibril-containing split fibers of the present invention also include surface-fibrillated fibers in which the fiber has split to produce a split fiber, as well as those in which the diameter of the split fiber is 2 micrometers or less, and the split fiber itself is in a fibrillar state. Accordingly, when the split fiber itself attains a fibrillar state, and forms an aggregate which is unitary with the fibrils, the diameter of the fiber is preferentially 2 micrometers or less, and it is more preferable that the fibrils and the fiber have a diameter of 1 micrometer or less.

In the present invention, the degree of beating may be freely controlled, and the precursor fibers may be blended with the beaten fibers, and the blending proportion thereof is not restricted.

By means of beating the precursor fibers, the fibers are caused to undergo further branching, and this results in fibers having a wide variety of diameters in a non-stepped manner, in which a portion of the fibers are completely split in the axial direction to form fibrillated fibers having a diameter of 2 micrometers, while another part of the fibers split only partially, and a further part of the fibers have diameters equal to those prior to beating. These fibers form an aggregate in which a portion of the fibers are fastened to one another so as to be continuous, while another portion are discontinuous. Such a fiber structure is preferable for use as the fiber base material in non-woven cloths and the like.

Furthermore, when beating is continued, ultimately an aggregate results composed of fibrils having a diameter of 2 micrometers or less (preferably 1 micrometer or less), and fibril-containing split fibers having a wide variety of diameters in a non-stepped manner at diameters of 5 micrometers or less (preferably, 2 micrometers or less), and an aspect ratio (l/d) of 1000 or more. Furthermore, the fibers are all split so as to achieve diameters equivalent to those of the fibrils, and almost all of the fibers are in a fibrillar shape and have a diameter of 2 micrometers or less.

The beating conditions may be altered and fibers having a desired shape formed, in accordance with the ultimate use of the fibers.

For example, when a sheet-form material such as non-woven cloth or the like for use in air filters is to be supplied, a structure is desirable in which a portion of the fibers are fibrillated in order to provide the appropriate degree of strength in the sheet, while when the use is for artificial leather, fibrils are desirable which have a structure in which essentially 100% of the fibers are in a fibrillar state in order to provide the special feel of animal hide.

Furthermore, for use as fibrils appropriate for tobacco filters, sufficient specific surface area is necessary to adsorb/filter the nicotine and tar, and it is also necessary to provide an appropriate shape to the tobacco filter.

Accordingly, it is possible to employ fibril system fibers in accordance with the present invention which use as the polymer thereof, from the point view of the taste of the tobacco smoke, cellulose acetate, as a tobacco filter, and the specific surface area thereof, although not restricted, should generally be 2 $m^2/g$ or more, and more preferably, 5 $m^2/g$ or more, since it is being used in combination with other elements when employed as a tobacco filter. When the specific surface area is 2 $m^2/g$ or less, there is insufficient adsorption/filtration of the nicotine and tar fractions.

It is possible to form the fibril system fibers comprising cellulose acetate into a tobacco filter by combining commonly known techniques. For example, after formation into a sheet-form material such as paper or a non-woven cloth, these materials may be used to produce a tobacco filter using a plug-winding machine. Furthermore, following a procedure in which activated charcoal is dispersed in a cellulose acetate tow, these cellulose acetate fibril system fibers may be dispersed in a cellulose acetate tow, and this may be worked into a tobacco filter using a plug-winding machine.

In this case, in the fibril system fibers comprising cellulose acetate, if the fibers are short, it is difficult to handle them during processing. For example, when paper making is conducted continuously by means of a wet method to obtain a sheet material, the fraction escaping from the paper making net is large, and this leads to a drop in the yield and a whitening of the waste water, and this is not desirable. When a sheet is formed by means of a dry method, the fibrillar fibers floating in the air stream increase, and there is a case that this will lead to a worsening of the operational environment. Furthermore, if short fibrils are present in large amounts in the sheet material, the mechanical strength declines, and this is not desirable. Accordingly, it is preferable that the length of the fibrillar fibers be such that the proportion passing through a 150 mesh in a screening test (Japan Industrial Standards (JIS) P-8207) is 10 weight percent or less.

Furthermore, it is preferable that the freeness of this fibrous material as measured by a Canadian Freeness Tester (JIS P-8121), which serves as an index of the degree of fibrillation, be 550 ml or more. When fibrils having a freeness of 550 ml or less are used to form a sheet by means of a wet paper making method, a fine paper-type sheet is formed, and the effective adsorption specific surface area declines, and this is not desirable. Furthermore, when this fine sheet is used to produce a filter, it is difficult to conduct uniform winding. As a result, "pores", which are unevenesses in the density in the cross section of the filter, are produced, and this leads to undesirable variation in ventilation resistance in the longitudinal direction, and this is not desirable.

Accordingly, fibril system fibers comprising cellulose acetate which meet these conditions comprise cellulose acetate in a fibrillar or film shape having a width within a range of 0.1 micrometer–30 micrometers and a length within a range of 10 micrometers–10 mm, and it is desirable that the proportion of fibrillar or film-shaped material having a length of 1000 micrometers or more be 5 weight percent or more.

The macromolecular polymer having a film formation ability which is employed in the present invention is not particularly restricted, insofar as it is a polymer which permits the preparation of a polymer solution using an appropriate solvent.

The possible states of such a polymer solution include two-phase separation solutions, liquid crystal solutions, or gel-type solutions or the like, so that the term solution is used with a wide meaning. Examples of such a macromolecular polymer include, for example, homopolymers of cellulose, cellulose ester, polyacrylonitrile, polyolefin, polyvinyl chloride, polyurethane, and polyester, as well as copolymers thereof. In particular, macromolecular polymers having a comparatively high glass transition temperature or macromolecular polymers which easily undergo thermal deformation, such as cellulose, cellulose acetate, polyacrylonitrile, polyvinyl chloride, and the like, are preferentially employed in comparison with the conventional method.

No particular restriction is made with respect to the solvent; solvents having a boiling point from low to high may be employed, and solvents which are compatible with water are advantageous from the point of view of effectively conducting cleaning after the formation of fibers.

Furthermore, the use of a mixture of two or more solvents, the use of a blended solvent with two or more macromolecular polymers, the concomitant use of various additives, or the addition of a coagulating agent in advance, are all possible.

The case in which cellulose is employed as the macromolecular polymer having the ability to form a film of the present invention will be explained in detail hereinbelow. The cellulose material employed in the present invention may be selected from among dissolved pulp and pulp flocks and the like. Hemicellulose, lignin, and the like may be contained in such pulp. It is preferable that the pulp which is used contain 90 weight percent or more of α-cellulose.

Either a sheet form or a powder form is appropriate for the pulp which is employed as the cellulose material. Sheet-form material may be shredded in a shredder or the like to produce chips. Furthermore, the pulp may be crushed into a granular form, insofar as the amount of cellulose molecules contained does not greatly decrease.

When cellulose is used as the macromolecular polymer capable of forming a film, the solvent employed in the present invention is a mixed solvent of N-methylmorpholine-N-oxide and a solvent (hereinbelow referred to as the non-solvent) which is incapable of dissolving cellulose but which is capable of uniformly mixing with this N-methylmorpholine-N-oxide. Here, water is preferentially used as the non-solvent.

In addition, it is also possible to use a mixed solvent of nitrodienedioxide ($N_2O_4$)/dimethylformamide (DMF), a mixed solvent of paraformaldehyde ($(CH_2O)_x$)/dimethyl sulfoxide (DMSO), or a mixed solvent of lithium chloride (LiCl)/dimethyl acetamide (DMAC), as the cellulose solvent.

The N-methylmorpholine-N-oxide in the mixed solvent is employed as a solvent which is capable of dissolving cellulose; however, in some cases, it is possible to use the other tertiary amine oxides disclosed in Japanese Patent Application, Second Publication No. Sho 55-41691, Japanese Patent Application, Second Publication No. Sho 55-46162, or Japanese Patent Application, Second Publication No. 55-41693 (or in the corresponding U.S. Pat. No. 4,211,574, U.S. Pat. No. 4,142,913, and U.S. Pat. No. 4,144,080) together with the N-methylmorpholine-N-oxide. In this case, the preferentially employed other tertiary amine oxides include ring mono (N-methyl amine-N-oxide) compounds similar to N-methylmorpholine-N-oxide; for example, N-methylpiperidine-N-oxide, N-methylpyrrolidone-N-oxide, and the like.

Furthermore, a preferable example of the non-solvent of the cellulose used in the present invention is water; however, a mixed solvent of water and an alcohol such as methanol, N-propanol, isopropanol, and butanol may also be used. Furthermore, a freely selected a protonic organic solvent, for example, toluene, xylene, dimethyl sulfoxide, dimethyl formamide, dimethyl acetamide, and the like, may be used as the cellulose non-solvent, insofar as it does not chemically react with N-methylmorpholine-N-oxide or cellulose.

Furthermore, it is possible to add a stabilizing agent to the mixed solvent. The most preferable stabilizing agent is propyl gallate; however, the other gallate esters disclosed in Japanese Patent Application, Second Publication No. Hei 3-29819 (or in the corresponding U.S. Pat. No. 4,426,228), for example, methyl gallate, ethyl gallate, isopropyl gallate, and the like, may also be employed. Furthermore, it is also possible to employ compounds having a chemical structure in which a double bond adjoins a carbonyl group, such as glycerin aldehyde, L-ascorbic acid, isoascorbic acid, triose reductone, and reductinic acid as stabilizing agents. Furthermore, ethylenediaminetetraacetic acid may also be used as a stabilizing agent in the cellulose formation solution of the present invention. Additionally, calcium pyrophosphate, or the calcium chloride and ammonium chloride disclosed in U.S. Pat. No. 4,880,469, may also be employed as inorganic compounds functioning as stabilizing agents in the cellulose formation solution of the present invention.

In the present invention, the cellulose polymer solution may be prepared continuously or in batches. In other words, continuous dissolution and preparation may be carried out using a screw-type extruder, or batch style dissolution and preparation may be carried out using a tank-type kneader which is provided with a heating mechanism and a pressure reducing evacuation mechanism. No particular restriction is made with respect to the temperature of the solution of the cellulose composition; however, it is preferable that this temperature be within a range of 90–120° C. When the solution temperature is too high, this leads to a reduction in the degree of polymerization as a result of the decomposition of the cellulose, and marked decomposition and discoloration of the solvent occur, and furthermore, when the temperature is too low, it is difficult to cause the cellulose to dissolve.

It is preferable that the total concentration of the cellulose composition in the cellulose polymer solution of the present invention be 30 weight percent or less, and in consideration of the molding characteristics of the solution for cellulose formation, and the throughput of the molded product, it is preferable that the cellulose composition concentration be within a range of 6–25 weight percent. Furthermore, it is preferable that the proportion of N-methylmorpholine-N-oxide and the solvent compatible with the N-methylmorpholine-N-oxide which serves as a non-solvent of the cellulose, which is contained in the mixed solvent used in the solution for cellulose formation, be within a range of 48–90 weight percent, and more preferably within a range of 5–22 weight percent. When water is employed as the non-solvent of the cellulose, it is preferable that, at the stage at which the cellulose is placed in the mixed solvent, the proportion of water be set high, at 20–50 weight percent, and after this, that the water be removed by heating under reduced pressure, so that the proportion of water is set to 5–22 weight percent.

Next, the case will be discussed in which cellulose ester is employed as the macromolecular polymer having the ability to form a film of the present invention.

The cellulose acetate which is employed in the present invention may be cellulose triacetate having a degree of acetylation within a range of 56.2%–62.5%, or may be cellulose diacetate with a degree of acetylation within a range of 48.8%–56.2%.

A single solvent such a methylene chloride, acetone, or the like, a mixed solvent of, for example, methylene chloride and methanol, or a tertiary amine oxide, which is a cellulose solvent, may be employed as the solvent of the cellulose acetate.

Furthermore, after conducting an acetylation reaction by means of a solvent method using cellulose as the base material, and obtaining a cellulose acetate solution, this cellulose acetate solution, from which the solvent has effectively not been removed and which has not been subjected to drying, may be employed as the spinning liquid. In such a case, no restrictions are made with respect to the cellulose acetate solvent employed insofar as it is a solvent which may be employed when conducting an acetylation reaction by means of a solvent method using cellulose as a raw material; however, it is preferable that the solution be cellulose acetate dissolved in aqueous acetic acid.

Commonly known chemical agents such as acetic acid or methylene chloride are chiefly used as the diluent in the manufacturing process in which the cellulose is acetylated.

It is possible to use a solution to which a precipitant has been added in such a range as not to cause the precipitation of the cellulose acetate. Water is commonly employed as the precipitant at this time; however, a mixed liquid of an alcohol, such as methanol or ethanol, and water may be employed.

Furthermore, it is preferable that the cellulose acetate solution of the present solution which is employed have added thereto a neutralizer serving to neutralize the residual acid catalyst which is used during the acetylation of the cellulose in order to avoid a reduction in molecular weight and a change over time in the degree of acetylation of the cellulose acetate obtained. Commonly known chemical agents such as magnesium acetate or the like may be employed as the neutralizer.

In addition to the high quality wood pulp having an α-cellulose content of 95% or more which is commonly employed, it is also possible to use low quality wood pulp having a α-cellulose content of less than 95% as the raw material cellulose. Furthermore, it is also possible to use non-wood pulp having an α-cellulose content of 90% or less as the cellulose acetylated raw material. However, if the α-cellulose content is too low, the non-acetylated fibrous materials and gel materials increase, and the nozzle is likely to clog when discharging the cellulose acetate solution from the spinning liquid discharge port as a spinning liquid, so that it is desirable that all solutions have an α-cellulose content of 80% or more.

The use of a tertiary amine oxide is effective in order to obtain the surface-fibrillated fibers, the fibril-containing split fibers, or the fibril-containing split fibers, almost all of which are in a fibrillar state, discussed in the present invention, or alternatively, it is also useful to employ two or more different types of mixed solutions into which is mixed at least one type of polymer other than cellulose acetate which is soluble in the cellulose acetate solution. Examples of these other polymers include, for example, cellulose, polyacrylonitrile system polymer, vinyl chloride, polyester system polymer, polysulfone, and the like, the use of a natural polymer such as cellulose and cellulose derivatives, in order to avoid degradation of the characteristics of the cellulose ester as a natural material, or the use of a polymer having the ability to form a film, such as an acrylonitrile system polymer or the like, in order to avoid deterioration in the suitability thereof as a fibrous material.

For example, the combination of cellulose and cellulose acetate can serve as a base fiber for artificial leather having the feel of a natural material, cigarette filters having superior adsorption of nicotine and tar, or non-woven cloth for filters which are biodegradable and have superior adsorption properties.

Furthermore, the combination of polyacrylonitrile and cellulose acetate may be used as a material for artificial leather having hygroscopicity and superior coloring properties, and may used as a base fiber for non-woven cloths having a soft feel.

In preparing the cellulose acetate polymer solution, flakes of cellulose triacetate or cellulose diacetate are dissolved in a single solvent such as methylene chloride, acetone, dimethyl acetamide, and the like, or in a mixed solvent of, for example, methylene chloride and methanol, and a spinning liquid having a solution concentration within a range of 15–30 weight percent, and preferably within a range of 18–27 weight percent, is prepared. Furthermore, when a tertiary amine oxide is employed, this may be accomplished using the method for preparing cellulose solutions.

When the macromolecular polymer having the ability to form a film of the present invention is a polyacrylonitrile system polymer, no particular restriction is made with respect to this acrylonitrile system polymer insofar as it is a polymer which forms standard acrylic fibers; however, the use of a polymer containing 50 weight percent or more of acrylonitrile as a monomer is preferable.

The copolymer component of the acrylonitrile is not particularly restricted insofar as it is a copolymer monomer producing standard acrylic fibers; for example, the following monomers are examples thereof. These include, for example, acrylate esters such as methyl acrylate, ethyl acrylate, isopropyl acrylate, n-butyl acrylate, 2-ethylhexyl acrylate, 2-hydroxyethyl acrylate, hydroxypropyl acrylate, and the like; methacrylate esters such as methyl methacrylate, ethyl methacrylate, isopropyl methacrylate, n-butyl methacrylate, isobutyl methacrylate, t-butyl methacrylate, n-hexyl methacrylate, cyclohexyl acrylate, lauryl acrylate, 2-hydroxyethyl methacrylate, hydroxypropyl methacrylate, diethylaminoethyl methacrylate, and the like; and unsaturated monomers such as acrylic acid, methacrylic acid, maleic acid, itaconic acid, acrylamide, N-methylolacrylamide, diacetone acrylamide, styrene, vinyl toluene, vinyl acetate, vinyl chloride, vinylidene chloride, vinylidene bromide, vinyl fluorine, and vinylidene fluoride, and the like. Furthermore, in order to improve coloring, it is possible to copolymerize p-sulfophenylmethacrylether, methacrylsulfonic acid, allylsulfonic acid, styrene sulfonic acid, 2-acrylamide-2-methylpropane sulfonic acid, and alkali metal salts thereof.

The molecular weight of the acrylonitrile system polymer used in the present invention is not particularly restricted; however, it is preferable that this molecular weight be 100,000 or more and 1 million or less. If the molecular weight is less than 100,000, the spinning qualities decline, and the quality of the thread tends to worsen. When the molecular weight is in excess of 1 million, the polymer concentration which provides the optimal viscosity for the spinning liquid becomes low, and there is a tendency for throughput to decline.

In the present invention, by using a polymer other than an acrylonitrile system polymer which can be dissolved in a solvent which dissolves acrylonitrile system polymer, together with acrylonitrile system polymer, it is possible to produce the surface-fibrillated fiber, fibril-containing split fibers, and fibril-containing split fibers, almost all of which are in a fibrillar shape, of the present invention.

Examples of these other polymers include, for example, polyether sulfone, polyallyl sulfone, polyimide, cellulose, cellulose acetate, other cellulose derivatives, vinyl chloride, polyester system polymers, polysulfone, and the like; from the point of avoiding deterioration in the feel of fiber material, cellulose and cellulose acetate are preferable, and furthermore, the use of polyether sulfone, polyallyl sulfone, polyimide, and polyvinylidene fluoride is effective in industrial uses requiring heat resistance and resistance to chemicals. The mixing proportions of the polymers differ depending on the polymers mixed. For example, when polyether sulfone is employed as the polymer other than the acrylonitrile system, and a surface-fibrillated fiber is produced, the mixing proportion of polyacrylonitrile system polymer/polyether sulfone is within a range of 60/40–5/95 weight percent, and preferably within a range of 50/50–10/90 weight percent.

The will be no problems with the state of the solution when a polymer other than acrylonitrile system polymer is employed, insofar a state is maintained which does not cause the mutual separation of the two macromolecular polymers; additionally, other polymers, fine metal granules, modifiers, or coagulating agents or the like may be added in advance.

With respect to the solvent for the acrylonitrile system polymer, an organic solvent such as dimethyl formamide, dimethyl acetamide, dimethyl sulfoxide, or the like, may be used, and it is also possible to use rhodanate, concentrated nitric acid, an aqueous solution of zinc chloride, or the like; no particular restrictions are made with respect to this.

The acrylonitrile system polymer solution may be easily prepared by dissolution in a solvent using a method commonly employed for fibers.

It is also possible to employ polyester as the macromolecular polymer having the ability to form a film of the present invention. In such a case, a polyester which uses chiefly ethylene terephthalate as the repeating unit is preferably employed. A common polyester of this type employs terephthalic acid or an ester forming a derivative thereof as the dicarboxylic acid component, and ethylene glycol or an ester forming a derivative thereof as the glycol component; however, a portion of this dicarboxylic acid component may be substituted for a different dicarboxylic acid component, and a portion of the glycol component may be substituted for another glycol component.

Examples of other dicarboxylic acid components include, for example, dicarboxylic acids such as isophthalic acid, monoalkali metal salts of 5-sulfoisophthalic acid, naphthalene dicarboxylic acid, diphenyl dicarboxylic acid, diphenyl sulfone dicarboxylic acid, adipic acid, sebacic acid, 1,4-cyclohexane dicarboxylic acid, and the like, and esters thereof, as well as oxycarboxylic acids such as p-oxybenzoate, p-β-oxyethoxybenzoate, and the like, and esters thereof.

Furthermore, examples of the other glycol components include, for example, 1,4-butane diol, alkylene glycols having a number of carbons within a range of 2–10, 1,4-cyclohexane dimethanol, neopentyl glycol, 1,4-bis (β-oxyethoxy) benzene, bisglycol ether of bisphenol A, polyalkylene glycol, and the like.

Furthermore, polycarboxylic acids such as trimellitic acid, and pyromellitic acid and the like, polyols such as pentaerythritol, trimethylolpropane, glycerin, and the like, and polymerization terminators such as monohydric polyalkylene oxide, phenyl acetate, and the like, may be employed, insofar as the polyester is essentially linear.

Such polyesters may be synthesized by means of freely selected commonly known methods. For example, using polyethylene terephthalate as an example, a method is commonly employed in which a glycol ester of terephthalic acid and/or a lower condensation product thereof may be synthesized by conducting a direct esterification reaction between terephthalic acid and ethylene glycol, or by conducting a transesterification reaction between a lower alkyl ester of terephthalic acid, such as dimethyl terephthalate and ethylene glycol, or by conducting an addition reaction in which ethylene oxide is added to terephthalic acid; next, the product thereof is subjected to polycondensation by means of a standard method. Furthermore, during the synthesis of the polyester in this invention, appropriate additives such as commonly known catalysts, antioxidants, coloring inhibitors, ether linkage byproduct inhibitors, flame retardants, or other additives, may be used.

Examples of the solvent used in the case in which polyester is employed, include, for example, single solvents as m-cresol, trifluoroacetic acid, O-chlorophenol, and the like, or mixed solvents of trichlorophenol and phenol, or of tetrachloroethane and phenol, or the like.

In the same way, in addition to the above, polyolefin system polymers such as polyethylene, polypropylene, and copolymers thereof, or vinyl system polymers such as polyvinyl chloride, polyvinyl fluoride, and copolymers thereof, and the like, may be used as the macromolecular polymer having the ability to form a film. In such a case, it is possible to use the following as solvents: aliphatic hydrocarbons such as pentane, hexane, heptane, octane, and the like, alicyclic hydrocarbons such as cyclohexane and the like, aromatic hydrocarbons such as benzene and toluene and the like, chlorinated solvents such as methylene chloride, or alcohols, ketones, ethers, esters, or mixed solvents thereof.

The manufacturing method for the fibril system fibers of the present invention will now be discussed. The fibril system fibers of the present invention are obtained by extruding a polymer solution, in which a macromolecular polymer having film forming ability is dissolved in a solvent, into a mixing cell via a spinneret orifice, while simultaneously, a coagulating agent fluid of this macromolecular polymer is sprayed into the mixing cell so as to travel in the direction of discharge of the polymer solution, the macromolecular polymer coagulates within the mixing cell in a shear flow, discontinuous fibrillated fibers are formed, and these fibrillated fibers are extruded together with the solvent and the coagulating agent fluid out of the mixing cell.

Here, it is possible to more effectively obtain the fibers, when discharging the solution of the macromolecular polymer having film forming ability from the spinning discharge port, by spraying the coagulating agent of the polymer from the coagulating agent fluid spray port at an angle greater than 0° but less than 90° with respect to the direction of discharge of the spinning liquid, coagulating this polymer in a shear flow, and washing the coagulum formed; by employing the coagulating agent fluid in a gas phase, or more preferably, employing a vapor; or by discharging, into coagulating agent, a mixed fluid of polymer, solvent, and coagulating agent fluid.

In the present invention, in order to spray the coagulating agent fluid so that this fluid flows in the direction of discharge of the spinning liquid, it is necessary that the angle formed by the spray direction of the coagulating agent fluid and the discharge direction of the spinning liquid be greater than 0° but less than 90°. If the angle formed by the spray direction of the coagulating agent fluid and the discharge direction of the spinning liquid is within this range, it becomes possible to quickly expel the coagulum formed and the mixed liquid of solvent and coagulating agent from the output of the mixing cell. Furthermore, the preferable angle is within a range of 20°–80°, and a more preferable range is from 30°–70°. By discharging and spraying both liquids in this range, the spinning liquid discharged into the mixing cell and the coagulating agent fluid sprayed into the mixing cell are sufficiently mixed, and the mixed liquid of the spinning liquid and coagulating agent fluid quickly becomes a shearing flow, and the polymer coagulates, and it is thus possible to obtain the discontinuous fibrillated fibers, or the surface-fibrillated fibers, described in the present invention.

When the spray direction of the coagulating agent fluid and the discharge direction of the spinning liquid are parallel, in other words, when the angle formed is 0°, the mixing of the spinning liquid and the coagulating agent fluid is insufficient, and the surface-fibrillated fibers obtained have a cross section which is rounded, elliptical, or rectangular, and the size of the cross section is also irregular, and this is not desirable; however, it is possible to obtain the fibers of the present invention by the admixture of other polymers or the selection of an appropriate solvent.

If on the other hand the angle is in excess of 90°, the spinning liquid and the coagulating agent fluid do mix sufficiently; however, the spinning liquid discharge port and the coagulating agent spray port and the like tend to become clogged with the coagulated polymer.

It is necessary to conduct discharge and spraying so that the spinning liquid and the coagulating agent fluid are sufficiently mixed, and it is necessary to regulate the angle between the discharge direction of the spinning liquid and the spraying direction of the coagulating agent fluid as described above, and in addition, it is preferable that the discharge port of the spinning liquid and the spraying port of the coagulating agent fluid be set in nozzles such that both liquids may come into contact with one another.

In the present invention, it is preferable that the spinning liquid be discharged, and the coagulating agent fluid be sprayed, into a mixing cell provided at the confluence of the spinning liquid discharge port and the coagulating agent fluid spraying port. The spinning liquid discharged into the mixing cell is mixed with the coagulating agent fluid within the mixing cell, and coagulation occurs as a result of the coagulating agent.

What is meant by the mixing cell in the present invention is the location at which the coagulation and shearing of the polymer occurs as a result of the mixing of the spinning liquid and the coagulating agent fluid; concretely, this mixing cell comprises a space having a fixed length which is provided downstream from the position at which the spinning liquid and the coagulating agent fluid come into contact.

In the present invention, what is meant by coagulation is the substitution of a minimum amount of solvent and coagulating agent forming surface-fibrillated fibers from the polymer solution; the coagulated fibers include a gel state containing the solvent.

In the manufacturing method of the present invention, although this is unclear, the coagulated polymer undergoes further coagulation within the mixing cell at shear flow speeds, and forms a fiber aggregate in which discontinuous fibrillated fibers having branching fibrils with a diameter of 2 micrometers or less, or surface-fibrillated fibers in which such fibers cover the surface of the fibers, are swollen in coagulating agent or solvent.

The mixed fluid of the coagulum formed, the solvent, and the coagulating agent fluid is expelled outside the nozzle system; however, with respect to the expulsion atmosphere, the coagulating agent gas phase or liquid phase, regulated by the coagulating agent or the mixed solvent of solvent and coagulating agent, may be appropriately selected. There are a large number of cases in which the expelled coagulum is in a state in which it is swollen with solvent, and if layering is directly conducted, the coagula may fuse, and there are cases in which the quality of the fibers obtained is negatively effected. For this reason, expulsion into, preferably, a liquid phase, or more preferably into a mixed liquid of the solvent of the polymer and the coagulating agent, allows the coagulation of the fibers in a swollen state to be completed, and permits the advantageous manufacture, from the point of view of efficiently conducting postprocessing such as washing or the like, of the discontinuous fibrillated fibers or surface-fibrillated fibers discussed in the present invention.

Furthermore, when the coagulum formed is injected directly into the coagulating agent, it is possible to form the surface-fibrillated fibers of the present invention even without a mixing cell.

In the present invention, the use, together with cellulose ester, of a polymer other than cellulose ester which is soluble in solvents which dissolve cellulose ester, is preferable. With respect to the combination of cellulose ester and another polymer, it is necessary to select a combination having differing coagulation properties with respect to the coagulating agent. The reason for this is unclear; however, it is thought that this serves to facilitate the generation of fibrils as a result of the different coagulation rates of each polymer during coagulation in which the spinning liquid discharged from the nozzle mouth is coagulated within the mixing cell under shearing conditions with coagulating agent fluid.

A combination of cellulose diacetate having a degree of acetylation of 58% or less and cellulose is preferable for use as this combination, and with respect to the solvents employed in such a case, a tertiary amine oxide, a mixed solvent of nitrodienedioxide ($N_2O_4$)/dimethyl formamide (DMF), a mixed solvent of lithium chloride (LiCl)/dimethyl acetamide (DMAC), or the like, may be employed, while water vapor may be employed as the coagulating agent.

Using polyacrylonitrile system polymer as the polymer other than cellulose ester, a combination of cellulose acetate and a polyacrylonitrile system polymer is preferable, and it is possible to use, for example, dimethyl formamide, dimethyl acetamide, or the like, as the solvent in such a case.

In the present invention, the precursor fibers of the surface-fibrillated fibers obtained in this manner may be made extremely thin by beating.

With respect to the beating method, the solution, dispersed in water, may be placed in a device such as commonly employed mixers or beaters or the like, and a fiber aggregate in which the proportion of precursor fibers and fibril-containing split fibers is altered may be obtained. It is possible to add thickeners or defoaming agents in accordance with the later processes in which a sheet form is produced. After cutting the precursor fibers to an appropriate length, an aqueous dispersion thereof may be prepared, and after producing a sheet form by means of a commonly employed method, beating may be conducted in a water flow or in an air flow.

With respect to the spinning nozzle for manufacturing the fibril system fibers of the present invention, a spinning nozzle for the production of fibers is preferably employed which is provided with: a polymer discharge part, having a polymer supply port to which a polymer solution is supplied, a polymer flow path which controls the discharge direction of the polymer solution, and a polymer discharge port from which the polymer solution is discharged; and a coagulating agent spraying part, which is provided with a coagulating agent supply port to which a coagulating agent fluid is supplied, a coagulating agent flow path which controls the spray angle of the coagulating agent fluid, and a coagulating agent spraying port from which the coagulating fluid is sprayed; wherein the nozzle is provided with a mixing cell part at the confluence of the polymer discharge port and the coagulating agent spraying port, and the mixing cell part has a length of at least 0.3 mm on the downstream side from the point of intersection between the central axis of the polymer flow path and the central axis of the coagulating agent flow path. Furthermore, it is possible to use, as such spinning nozzles, spinning nozzles in which the mixing cell part has a length of at least 10 mm on the downstream side from the intersection point of the central axis of the polymer flow path and the central axis of the coagulation agent flow path, or spinning nozzles in which the polymer discharge port is positioned on the upstream side of the intersection point between the central axis of the polymer flow path and the central axis of the coagulation agent flow path, or spinning nozzles in which the angle θ formed by the central axis of the polymer flow path and the central axis of the coagulating agent flow path is greater than 0° and less than 90° with respect to the discharge direction of the polymer; it is possible to conduct an appropriate selection based on the type of polymer employed, or the form of the fibril system fibers obtained.

Figure 3:
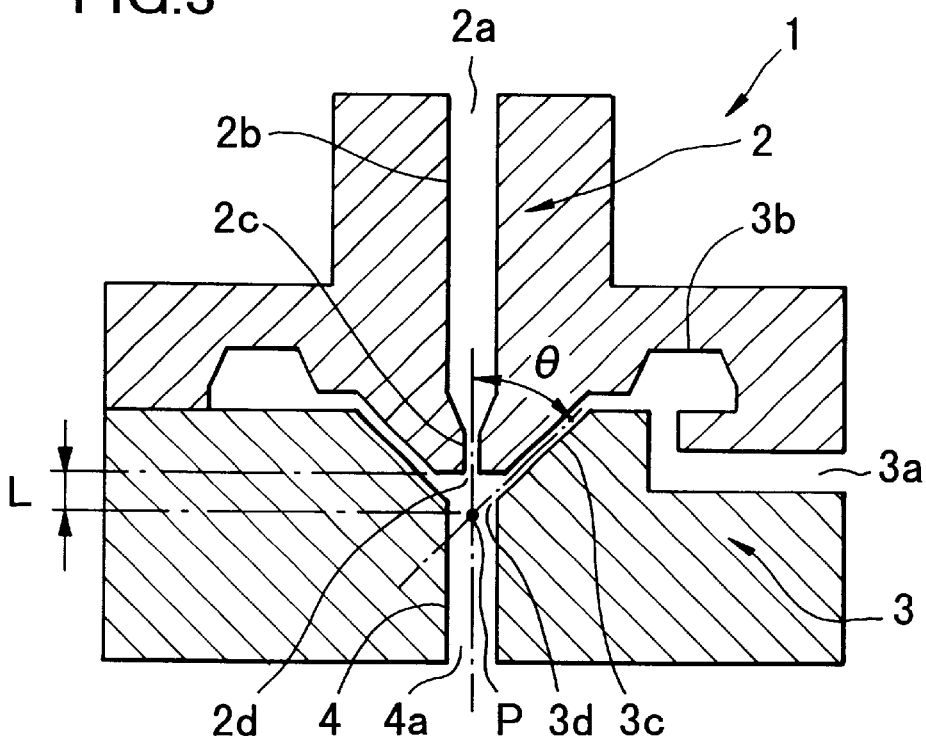
FIG. 3 is a cross-sectional view of a spinning nozzle in accordance with the present invention.

FIG. 3 shows a schematic diagram of a spinning nozzle 1 in accordance with a representative mode of the present invention.

Spinning nozzle 1 of the present invention is provided with a discharge part 2 for polymer solution, a spraying part 3 for coagulating agent fluid, and a mixing cell part 4 in which the polymer solution and the coagulating agent fluid flow together; the mixing cell part 4 is disposed along a straight line along the downstream flow direction from polymer discharge part 2.

Polymer discharge part 2 is provided with a supply chamber 2*b* which is coupled with the supply port 2*a* of the polymer solution and a polymer flow path 2*c* which controls the discharge direction of the polymer solution. Supply chamber 2*b* has a cylindrical shape extending in the vertical direction, and the lower end thereof gradually narrows and is connected in a straight-line manner with a capillary-shaped polymer flow path 2*c*. Supply port 2*a* and supply chamber 2*b* may be appropriately designed in accordance with the polymer and solvent employed in the polymer solution, the viscosity of the polymer solution, or the amount discharged. The capillary-shaped polymer flow path 2*c* communicates with the upper wall surface of mixing cell part 4 and forms a discharge port 2*d* for the polymer solution. Polymer flow path 2*c* need only be set to such a length that the polymer solution does not proceed in a diagonal manner when it is discharged from polymer discharge port 2*d* and flows together with the coagulating agent fluid; this may be easily achieved with a structure commonly employed in spinning nozzle shapes used in the spinning of fibers from polymer solutions.

Figure 4:
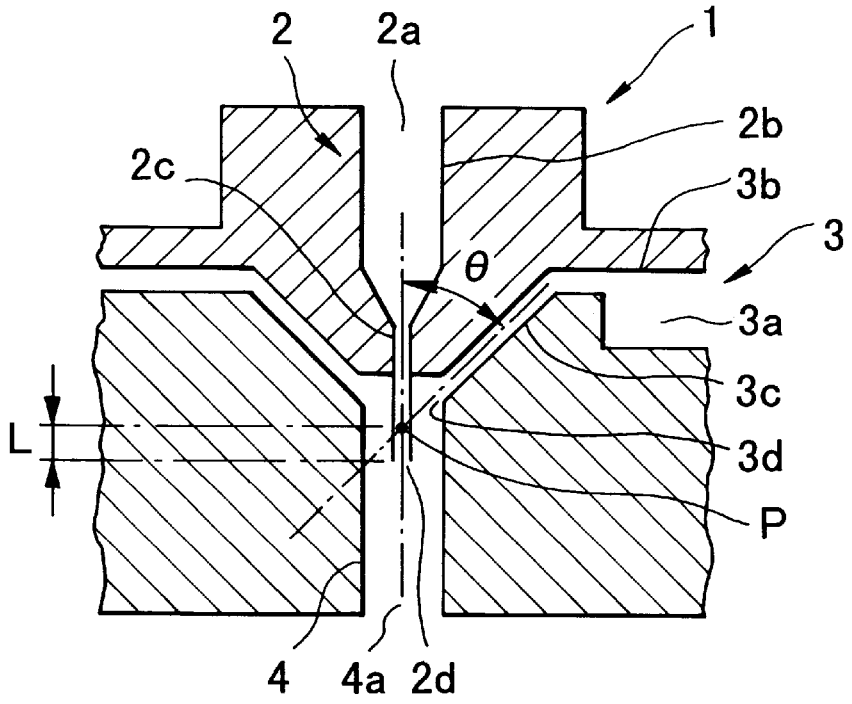
FIG. 4 is a cross-sectional view of a spinning nozzle in accordance with another embodiment of the present invention.

Furthermore, as shown in FIG. 4, it is also possible to project the polymer flow path 2*c* from the upper wall of mixing cell part 4 to form polymer discharge port 2*d* in approximately the center of mixing cell part 4. Furthermore, in order to control the discharge direction of the polymer solution, it is also possible to form a tapered narrowing part in the downstream part of polymer flow path 2*c*, and to form the downstream part of the narrowing part into a capillary shape; the form of the polymer flow path 2*c* may be appropriately selected in accordance with the polymer solution. The size of the polymer discharge port 2*d* may be appropriately selected in accordance with the viscosity of the polymer solution or the amount discharged; however, the diameter of the mouth of the nozzle used in the spinning of the polymer solution should preferably be within a range of approximately a few tens of micrometers to a few millimeters.

Coagulating agent spraying part 3 is provided with a supply chamber 3*b* in which a supply port 3*a* for the coagulating agent fluid is formed, and a coagulating agent flow path 3*c* which controls the discharge direction of the coagulating agent fluid; the coagulating agent flow path 3*c* communicates with the upper wall surface of the mixing cell part 4 and forms a circular opening enclosing polymer discharge port 2*d*, an opening which forms the spraying port 3*d* of the coagulating agent fluid. It is also possible to form coagulating agent flow path 3*c* so as to communicate with the side wall surface of mixing cell part 4.

Coagulating agent flow path 3*c* is formed so that the angle θ formed between the central axis thereof and the central axis of the polymer flow path 2*c* is within a range of $0° < \theta < 90°$, with respect to the discharge direction of the polymer solution. When the angle θ has a value of 0°, in other words, when the spraying direction of the coagulating agent fluid and the discharge direction of the polymer solution are identical, the fibers form a film in an undesirable manner, and there are very few branching fibrillated fibers, and it is impossible to obtain a large amount of fibrillated fibers. On the other hand, when the angle is in excess of 90°, it is difficult to smoothly expel the discontinuous fibrillated fibers generated and the mixed fluid of solvent and coagulating agent from the mixing cell part 4, and clogging is likely to develop within the mixing cell part 4. In order to increase the degree of fibrillation, and to provide the optimum form for basic fibers for non-woven cloths employed in filters and the like, the coagulating agent flow path 3*c* should be set so that the angle θ is within a range of 20°–80°, and more preferably within a range of 30°–70°.

Coagulating agent flow path 3*c* is formed so that the polymer discharge port 2*d* is disposed on the upstream side of the point of intersection P between the central axis of the coagulating agent flow path 3*c* and the central axis of the polymer flow path 2*c*. The distance L between the point of intersection P and the polymer discharge port 2*d* is preferably within a range of $0\ \text{mm} \leqq L \leqq 10\ \text{mm}$. When the polymer discharge port 2*d* is on the downstream side from the point of intersection P, the polymer solution and the coagulating agent fluid are not sufficiently mixed, and the degree of fibrillation becomes extremely small, while the form of the main fiber is either elliptical, or a film is formed, and this is not desirable. Furthermore, when the discharge port is too far upstream from the point of intersection P, the mixing of the polymer solution and the coagulating agent fluid does not proceed smoothly, polymer solution is deposited on the side walls of the mixing cell part 4, and this leads to blockage of the mixing cell part 4.

Furthermore, it is preferable, in order to increase the degree of fibrillation, that the polymer discharge port 2*d* and the coagulating agent spraying port 3*d* be as close as possible, given the restrictions imposed by production of the nozzle.

Furthermore, if coagulating agent flow path 3*c* is given a circular slit shape enclosing polymer discharge port 2*d*, then it is possible to evenly spray the coagulating agent fluid at the position of the polymer solution discharged from polymer discharge port 2*d*, and this is desirable.

Furthermore, it is also possible to dispose a plurality of capillary-shaped flow paths in a radial manner with the polymer discharge port 2*d* at the center. When coagulating agent flow path 3*c* is made slit-shaped, no particular restriction is made with respect to the aperture of the slit; however, it is possible to set this within a range of approximately a few tens of micrometers. It is preferable that the amount of coagulating agent fluid sprayed be set in accordance with the amount of polymer solution discharged so that it is possible to obtain the desired discontinuous fibrillated fiber form. Furthermore, it is preferable that the coagulating agent fluid be sprayed in a gaseous state; however, it is preferable that the amount of coagulating agent fluid discharged be controlled by conducting pressure control rather than by controlling the aperture of the slit. Furthermore, the coagulating agent fluid spraying port may also be provided in the center of the polymer solution.

Mixing cell part 4 is provided with the polymer discharge port 2*d* and the coagulating agent spraying port 3*d* in the upper wall thereof, and the bottom part thereof is open, forming a cylindrical shape forming exhaust port 4*a*; the diameter thereof is greater than 1 mmϕ but less than 6 mmϕ. The mixing cell part 4 must have a length of 0.3 mm or more on the downstream side from the point of intersection P between the central axis of the polymer flow path 2*c* and the central axis of the coagulating agent flow path 3*c*; this may be set appropriately in accordance with the amount of polymer solution discharged, the amount of coagulating agent fluid sprayed, or the form of the fibrillated fibers desired. A length is required for mixing cell unit 4 which is sufficient to guarantee the time necessary for the polymer solution to coagulate in a fibrillar shape and for the formation of branched fibrillated fibers from the polymer by shearing; in order to increase the length of the fibrils, it is preferable that a length of 1 mm or more be present on the downstream side from the point of intersection P, and a length of 10 mm or more is more preferable, while a length of 30 mm or more is still more preferable.

As the length of the mixing cell part 4 increases, the average denier of the fibers obtained is reduced, and the proportion of branching fibrillated fibers increases, and this provides a superior form for use as a fibrous base material in non-woven cloth which is employed in filtering applications; however, if the length is increased excessively, clogging is likely to occur as a result of the fibers generated. If on the other hand the length of the mixing cell part 4 is shortened, the average denier of the fibers increases, and the number of branching fibrillated fibers decreases, and these are insufficient for use as fibers in non-woven cloths or the like which employ the superior adsorbent properties of very fine fibrillated fibers.

The diameter of mixing cell 4 is an important factor in controlling the linear flow rate of the coagulating agent fluid within the mixing cell part 4, which is an important condition for forming the fibers which are the object of the present invention; it is necessary to set the diameter to a size such that a sufficient linear flow rate can be obtained. The cell is not limited to the cylindrical shape described above; a rectangular slit may also be employed, and in such a case, it preferable that the width of the cross section be greater than 1 mm but less than 6 mm. If the cross-sectional area of the mixing cell part 4 is reduced, the linear flow rate does increase; however, clogging is easily generated by the fibers formed, and this is not desirable. If on the other hand the cross-sectional area of the mixing cell part 4 is increased, the linear flow rate of the coagulating agent fluid decreases, and the proportion of fibrillated fibers decreases. In the case in which the coagulating agent fluid is used in a gaseous state, a flow rate of 100 m/sec or more is required in order to form the desired fibers. Even if the cross-sectional area of mixing cell part 4 increases, it is possible to guarantee the necessary linear flow rate by increasing the amount of flowing gas; however, the increase in the amount of gas flowing increases the burden in the postprocessing such as solvent recovery, and the like, and the economic disadvantages become great. It is possible to achieve the objects of the present invention even if the shape of mixing cell part 4 is circular or rectangular or the like in cross section, so long as a cross-sectional area is maintained which is sufficient to guarantee a sufficient length and the necessary linear flow rate, as described above. Furthermore, it is possible to give the mixing cell part 4 a shape in which the cross-sectional area thereof gradually decreases or gradually increases in the direction of the exhaust port 4*a*, and it is also possible to make the lead end of the mixing cell part 4 rounded and to widen the exhaust port 4*a*.

Furthermore, it is also possible to provide a plurality of polymer discharge ports 2*d* in the mixing cell part 4, and to dispose coagulating agent spraying ports 3*d* for each of the plurality of polymer discharge ports 2*d*, and to provide these in a single mixing cell part 4; it is thus possible to obtain a spinning nozzle having a high throughput.

Here, a polymer solution prepared by means of a conventional method is supplied from the polymer supply port 2*a* to the polymer discharge part 2, and a coagulating agent fluid prepared by a conventional method is supplied from coagulating agents supply port 3*a* to coagulating agent spraying part 3. The polymer solution passes through the supply chamber 2*b* of the polymer supply part 2 and the direction of discharge thereof is determined by the polymer flow path 2*c*, and the solution is discharged from polymer discharge port 2*d* into mixing cell part 4. At the same time, the coagulating agent fluid passes through the supply chamber 3*b* of the coagulating agent spraying part 3 and the spray angle thereof is determined by coagulating agent flow path 3*c*, and the fluid is sprayed from coagulating agent spraying port 3*d* into mixing cell part 4 in the direction of the polymer solution. The polymer solution mixes with the coagulating agent fluid which was sprayed, and the solution undergoes coagulation and shearing within mixing cell part 4 to produce the discontinuous fibrillated fibers.

The spinning nozzle of the present invention is not necessarily limited to the modes described above; appropriate modifications thereof are possible insofar as the conditions of the present invention are fulfilled.

Hereinbelow, embodiments spun using the spinning nozzle of the present invention will be discussed. The embodiments below are only presented for the purposes of explanation; the scope of the present invention is in no way restricted to the embodiments given hereinbelow.

The nozzle 1 depicted in FIG. 3 was used as the spinning nozzle, and the polymer supply chamber 2*b* of nozzle 1 had a cylindrical shape with a length of 96 mm and a diameter of 3 mmϕ, while the polymer flow path 2*c* had a capillary shape. Coagulating agent flow path 3*c* had a slit shape, and the angle θ formed by the central axis of the polymer flow path 2*c* and the central axis of the coagulating agent flow path 3*c* was 60°. Additionally, with respect to the length of the polymer flow path 2*c*, the diameter of the polymer discharge port 2*d*, the slit aperture of the coagulating agent flow path 3*c*, the distance L between the polymer discharge port 2*d* and the point of intersection P between the central axis of the polymer flow path 2*c* and the central axis of the coagulating agent flow path 3*c*, the diameter of the mixing cell part 4, and the length of the mixing cell part on the downstream side from the point of intersection P, these values were all independently altered, and the values thereof are shown in Table 1.

Embodiment 1

117 g of cellulose (produced by P & G Cellulose, dissolving pulp V-60), 2000 g of N-methylmorpholine-N-oxide (produced by Sun Technochemical Co., Ltd.) containing approximately 41 weight percent of water, and 15 g of propyl gallate were placed in a mixer with an attached vacuum defoaming device (model ACM-5, produced by Kodaira Seisakusyo Co., Ltd.), and while mixing for a period of approximately 2 hours while heating under reduced pressure, 648 g of water was removed, and a uniform solution of cellulose was prepared. During the dissolution process, the temperature of the oven was maintained at 100° C.

Next, while maintaining the temperature of the solution obtained at 100° C., extrusion was carried out under nitrogen pressurization of 1.5 kg/cm$^2$, and a standard amount thereof was supplied to the nozzle part shown in FIG. 3 using a gear pump. The amount of cellulose solution discharged was determined by the rotational speed of the gear pump. A vapor was used as the coagulating agent fluid, and the amount of vapor supplied was controlled by setting the supply pressure using a pressure reducing valve. The amount of vapor was measured by altering the supply pressure from the nozzle shown in FIG. 3 and spraying only vapor into water, and obtaining the increase in the weight per unit time.

Using a nozzle (Table 1, nozzle A) produced so that the diameter of the polymer solution discharge port 2*d* was 0.2 mmϕ, the diameter of the mixing cell part 4 was 2 mmϕ, the length was 54 mm, the slit aperture of the coagulating agent flow path was 390 micrometers, and the angle formed by the line of discharge of the polymer solution and the line of discharge of the vapor was 60°, the cellulose solution was sprayed into water having a temperature of 30° C. at a supply rate of 6.0 ml/min and a vapor supply pressure of 1.5 kg/cm$^2$. The amount of vapor consumed at this time had a water equivalent of 87 g/min, and the linear flow rate of the vapor within the mixing cell was calculated to be approximately 800 m/sec.

The cellulose fibers floating in the coagulating liquid were recovered, and these were washed for a period of one hour in boiling water, and were then dried at room temperature.

Using a scanning electron microscope, the state of the surface of the cellulose fibers obtained was observed.

Furthermore, the form of the fibers in the longitudinal direction was observed using projection-type stereoscopic microscope (the Profile Projector V-12, produced by Nikon).

The form of the cellulose obtained was an aggregate of discontinuous fibrillated fibers; with respect to the diameter, these had a wide distribution, from approximately 0.1 micrometer to 50 micrometers, while with respect to the length of the fibers, a wide distribution was also observed, from a length of approximately 5 mm to a length of approximately 5 cm. Furthermore, the fibers had a branched structure; a structure was observed in which thin fibers of a few micrometers or less branched from the side surfaces of fibers of a few tens of micrometers.

Figure 7:
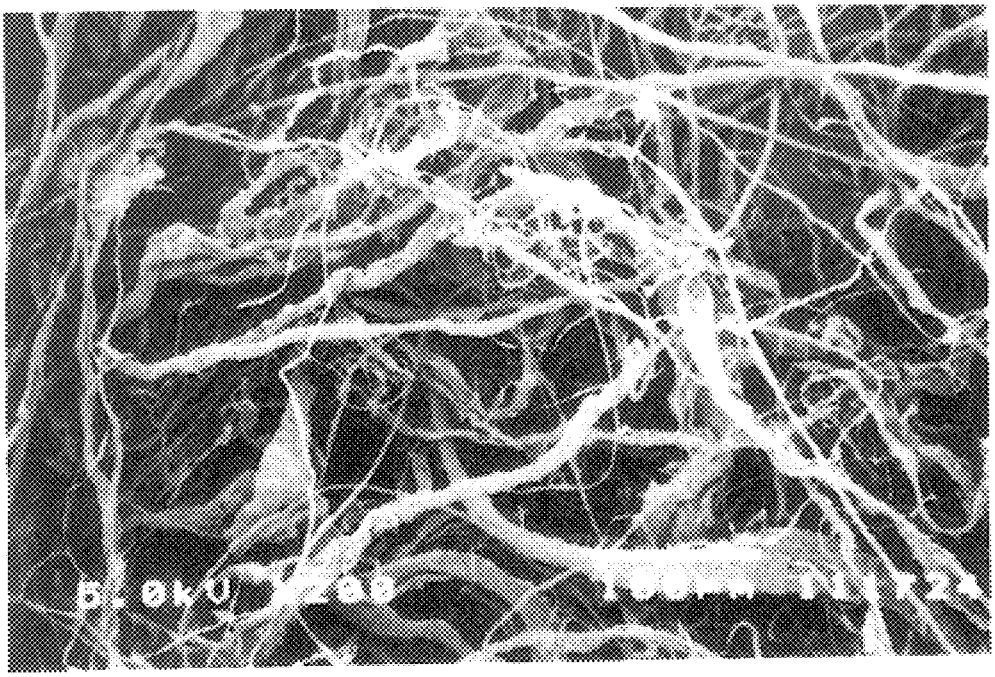
FIG. 7 is an electron micrograph (200 times magnification) of discontinuous fibrillated fibers obtained in embodiment 1.

A micrograph of the cellulose fiber obtained is shown in FIG. 7.

Embodiment 2

A cellulose solution was prepared in a manner identical to that of embodiment 1, and cellulose formation was conducted using a nozzle identical to that of embodiment 1. The amount of cellulose solution supplied was changed so as to be 3.0 ml/min (in embodiment 2-1) and 12.0 ml/min (in embodiment 2-2), and cellulose spinning was conducted.

Figure 8:
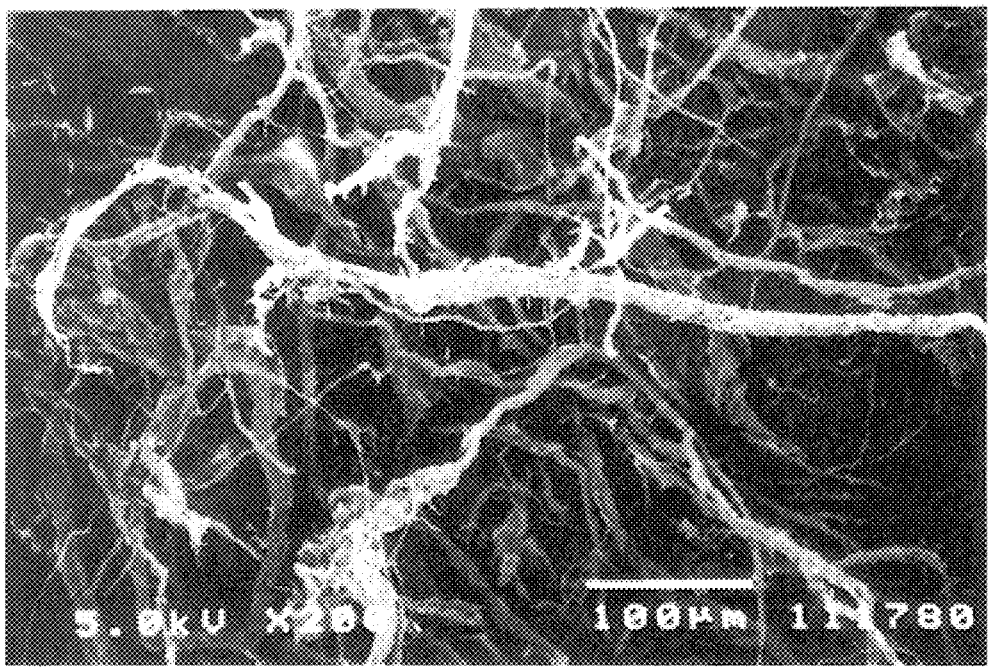
FIG. 8 is an electron micrograph (200 times magnification) of discontinuous fibrillated fibers obtained in embodiment 2-1.
Figure 9:
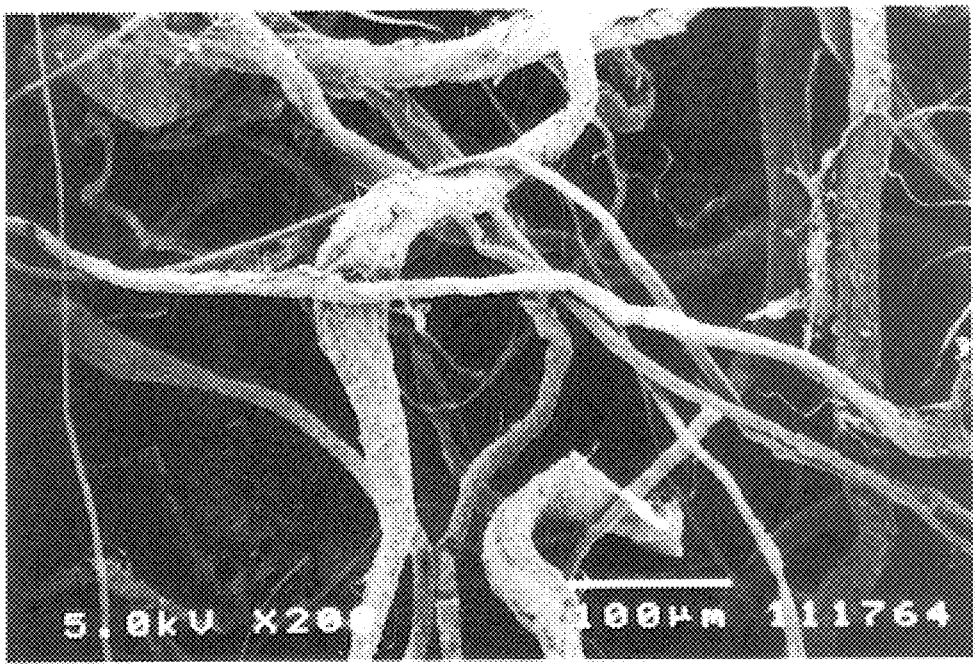
FIG. 9 is an electron micrograph (200 times magnification) of discontinuous fibrillated fibers obtained in embodiment 2-2.

Electron micrographs of the cellulose fibers obtained are shown in FIGS. 8 and 9.

When the amount of solution discharged decreases, the fibers become thinner on average, and although fibrillation proceeds, the length of the fibers is shortened. When, on the other hand, the amount of solution discharged is increased, the average diameter of the fibers also increases, and the degree of fibrillation declines.

By altering the amount of solution discharged, the changes in the average fiber diameter and fibrillation state were observed.

Embodiment 3

A cellulose solution was prepared using a method identical to that of embodiment 1. A nozzle identical to that of embodiment 1, with the exception that the slit aperture of the coagulating agent fluid was set to 250 micrometers, was employed, and the amount of cellulose solution supplied was set to 6.0 ml/min, while the supply pressure of the vapor of was set to 2 kg/cm$^2$. The amount of vapor consumed at this time had a water equivalent of 82 g/min. In the same manner as in embodiment 1, the cellulose fibers floating in the coagulating liquid were recovered, these were then washed for a period of 1 hour in boiling water, and dried at room temperature.

Figure 10:
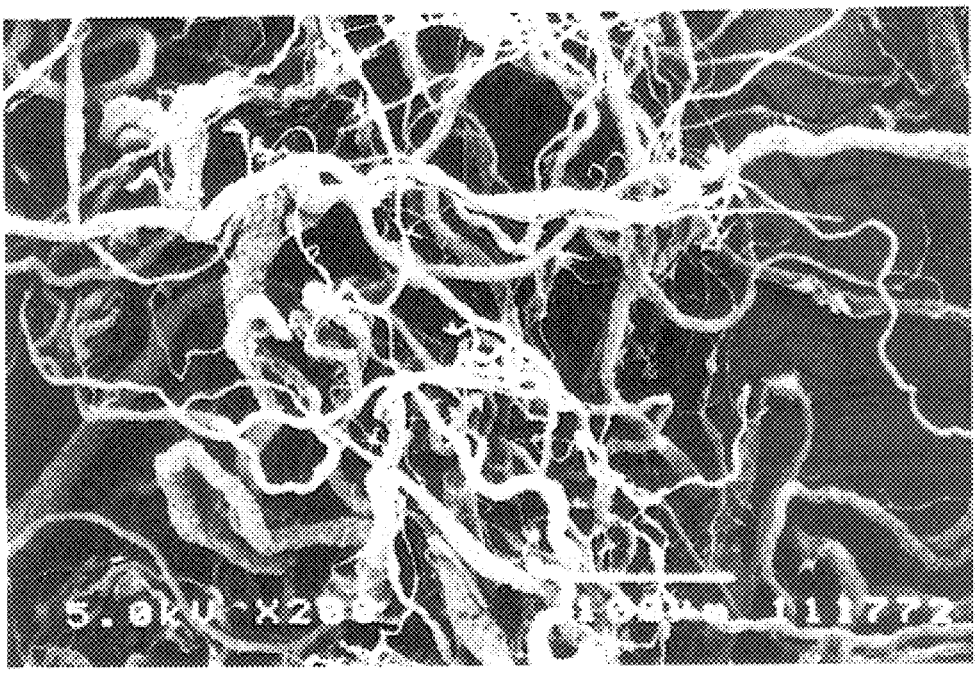
FIG. 10 is an electron micrograph (200 times magnification) of discontinuous fibrillated fibers obtained in embodiment 3.

An electron micrograph of the fibers obtained is shown in FIG. 10.

The cellulose form obtained was an aggregate of discontinuous fibrillated fibers, as in embodiment 1, and a structure in which thin fibers of a few micrometers or less branched from side surfaces of fibers of few tens of micrometers was observed.

Embodiments 4-1, 4-2

A cellulose solution was prepared by a method identical to that of embodiment 1, and using nozzle B of 1 in embodiment 4-1, and using nozzle C of 1 in embodiment 4-2, cellulose fibers were spun under conditions identical to those of embodiment 1 described above.

Figure 11:
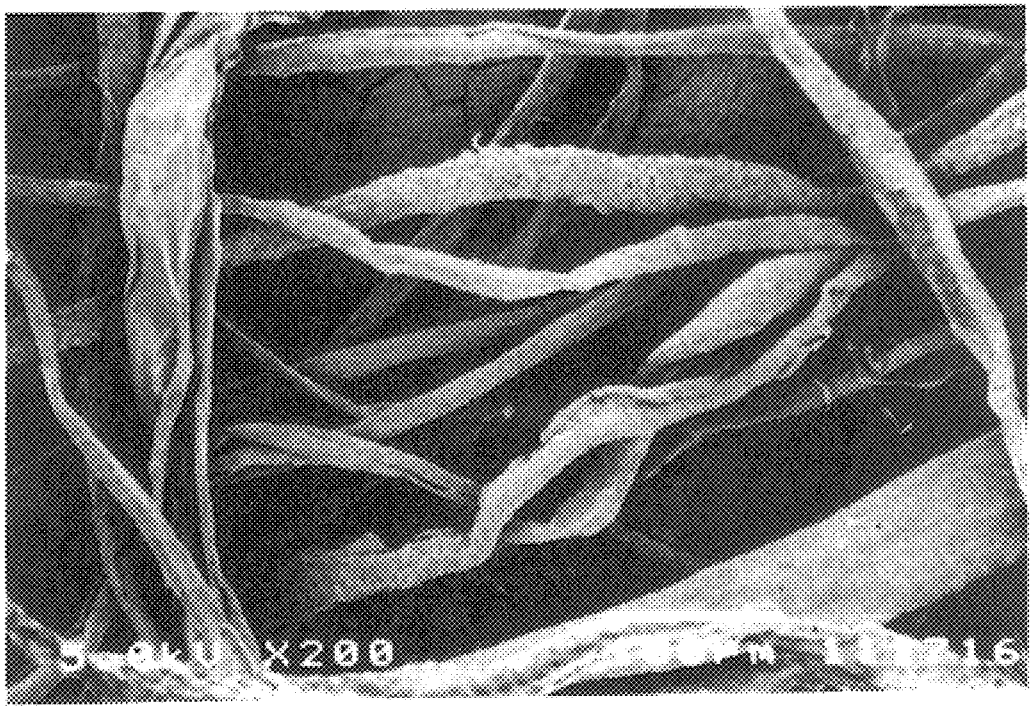
FIG. 11 is an electron micrograph (200 times magnification) of discontinuous fibrillated fibers obtained in embodiment 4-1.
Figure 12:
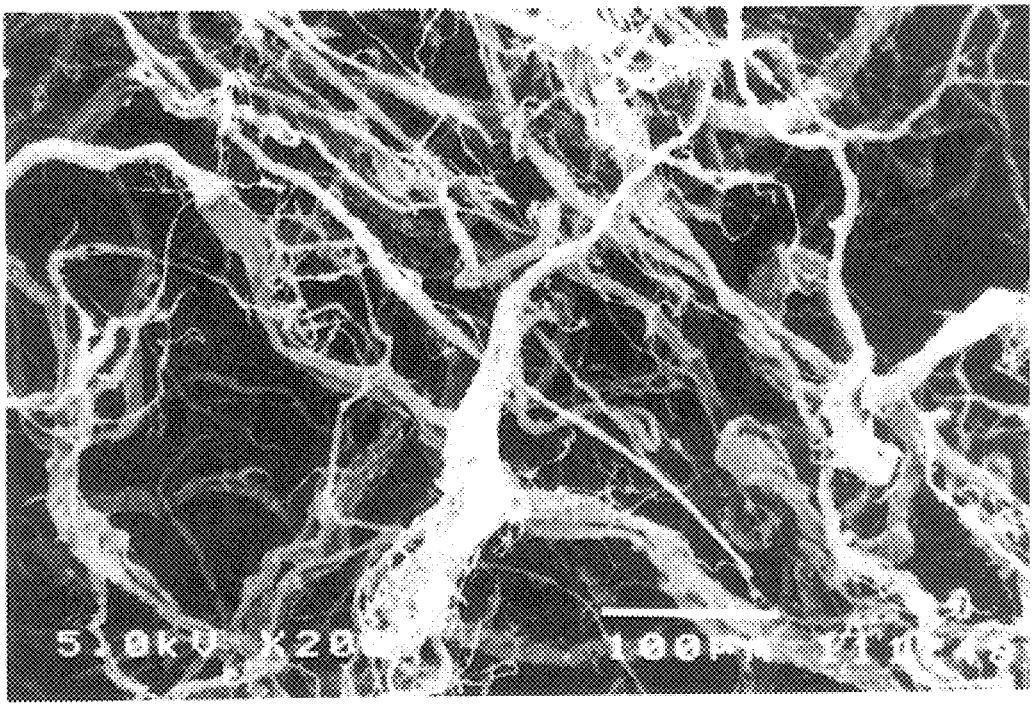
FIG. 12 is an electron micrograph (200 times magnification) of discontinuous fibrillated fibers obtained in embodiment 4-2.

An electron micrograph of the fibers obtained in embodiment 4-1 is shown in FIG. 11, while an electron micrograph of the fibers obtained in embodiment 4-2 is shown in FIG. 12.

From these figures, it can be seen that when the length of the mixing cell increases, the fibers become thinner, and branched fibrils develop.

Embodiment 4-3

A cellulose solution was prepared by a method identical to that of embodiment 1, and using the nozzle D of 1, cellulose fibers were spun under conditions identical to those of embodiment 1.

Figure 13:
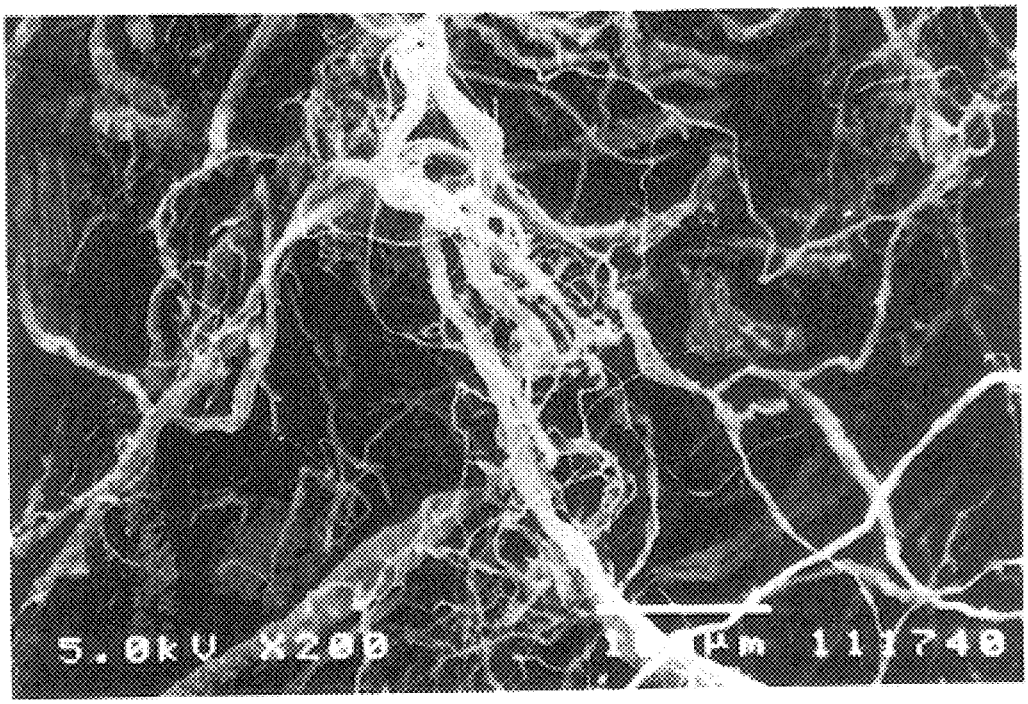
FIG. 13 is an electron micrograph (200 times magnification) of discontinuous fibrillated fibers obtained in embodiment 4-3.

An electron micrograph of the fibers obtained is shown in FIG. 13.

The cellulose form obtained was an aggregate of discontinuous fibrillated fibers, and a structure was observed in which thin fibers of a few micrometers or less branched from the side surfaces of fibers of few tens of micrometers.

Embodiment 4-4

Figure 14:
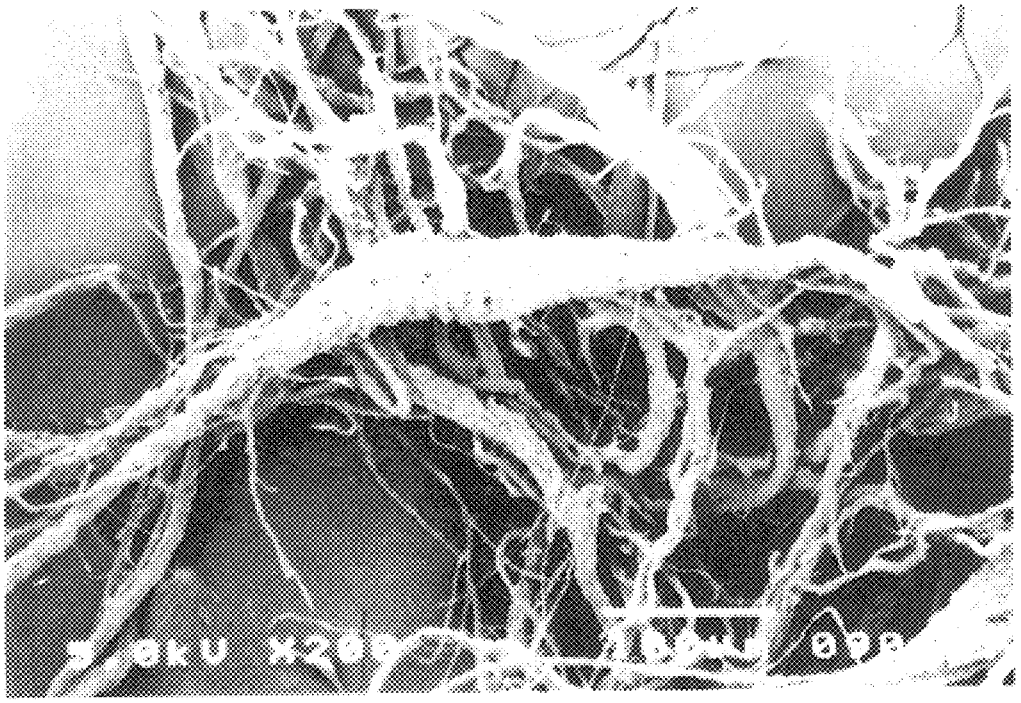
FIG. 14 is an electron micrograph (200 times magnification) of discontinuous fibrillated fibers obtained in embodiment 4-4.

A cellulose solution was prepared by method identical to that of embodiment 1, and using the nozzle E shown in Table 1, cellulose fibers were spun under conditions identical to those of embodiment 1. An electron micrograph of the fibers obtained is shown in FIG. 14.

The cellulose form obtained was an aggregate of discontinuous fibrillated fibers, and a structure was observed in which thin fibers of few micrometers or less branched from the side surfaces of fibers of a few tens of micrometers.

Embodiment 4-5

A cellulose solution was prepared by a method identical to that of embodiment 1, and the nozzle F of 1 was employed. As in embodiment 1, the cellulose solution was supplied at a rate of 6 g/min, and the supply pressure of the vapor was set to 1.5/cm$^2$. At this time, the nozzle F had a slit aperture which was different than that of the nozzle A of embodiment 1, so the vapor flow rate was set to 70 g/min.

Figure 15:
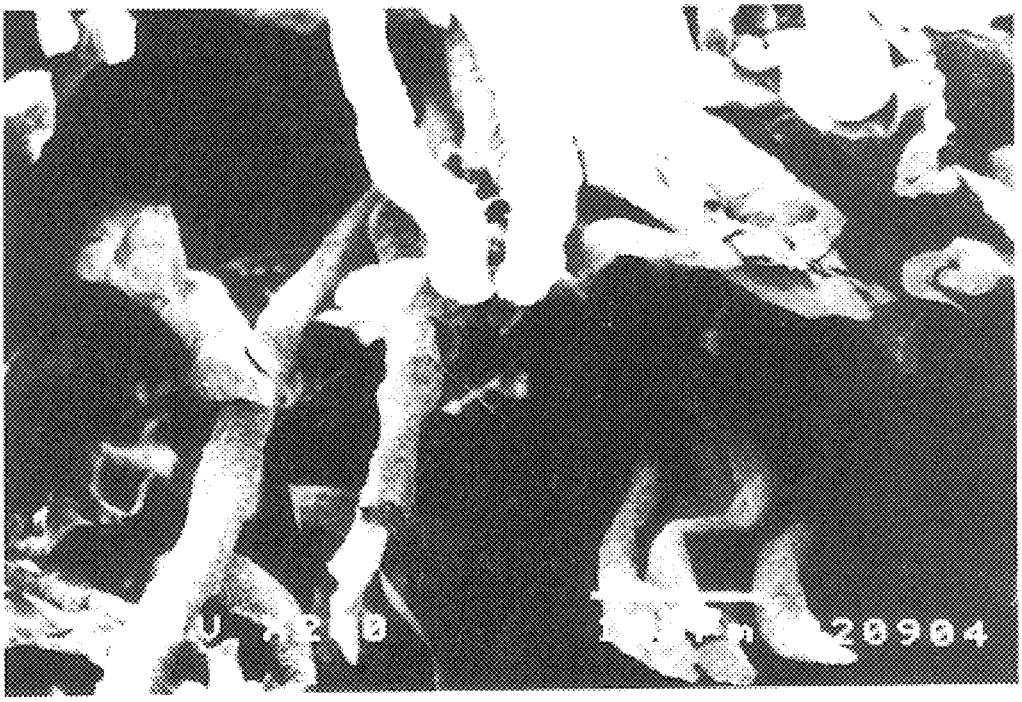
FIG. 15 is an electron micrograph (200 times magnification) of discontinuous fibrillated fibers obtained in embodiment 4-5.

An electron micrograph of the fibers obtained is shown in FIG. 15.

When the form of the cellulose fibers attained was observed, fibers were observed which had a large diameter, and were partially fibrillated.

TABLE 1

NOZZLES USED IN THE EMBODIMENTS OF THE PRESENT INVENTION

| Nozzle | A | B | C | D | E | F |
|---|---|---|---|---|---|---|
| Polymer Solution Flow Path Length (mm) | 0.2 | 0.2 | 0.2 | 0.1 | 0.2 | 0.2 |
| Polymer Solution Discharge Port Diameter (mm) | 0.2 | 0.2 | 0.2 | 0.1 | 0.2 | 0.2 |
| Slit-shaped Coagulating Solution Flow Path Aperture (microns) | 390 | 390 | 390 | 390 | 390 | 250 |
| Distance L Between the Polymer Solution Discharge Port and the Point of Intersection P (mm) | 0.8 | 0.8 | 0.8 | 0.8 | 1.2 | 0.7 |
| Diameter of the Mixing Cell Part (mmϕ) | 2.0 | 2.0 | 2.0 | 2.0 | 4.0 | 2.0 |
| Length of the Mixing Cell Below the Point of Intersection (mm) | 54 | 14 | 104 | 54 | 53 | 1.5 |

Embodiment 5

A cellulose solution was prepared by a method identical to that of embodiment 1, and using a nozzle having a shape an dimensions identical to that of nozzle A of embodiment 1, with the exception that the downstream end part of the mixing cell part 4 widened in a trumpet shape in the direction of exhaust port 4*a*, cellulose fibers were formed under conditions identical to those of embodiment 1.

Figure 16:
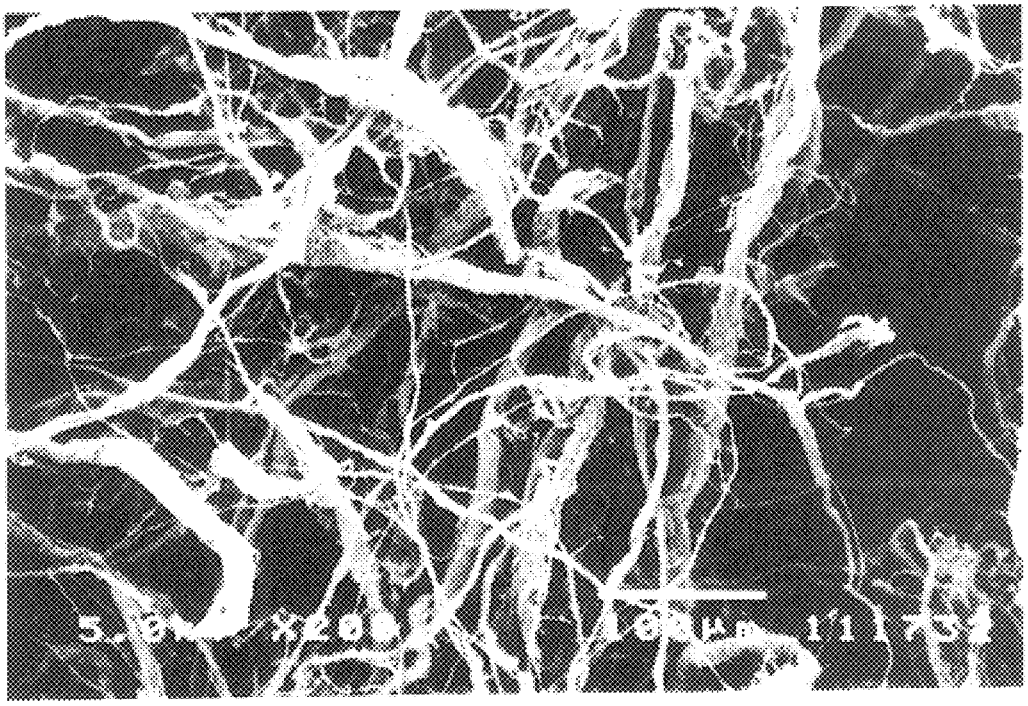
FIG. 16 is an electron micrograph (200 times magnification) of discontinuous fibrillated fibers obtained in embodiment 5.

An electron micrograph of the fibers obtained is shown in FIG. 16. As in embodiment 1, the cellulose form obtained was an aggregate of discontinuous fibrillated fibers, and a structure was observed in which thin fibers of a few micrometers or less branched from the side surfaces of fibers of a few tens of micrometers.

Embodiment 6

Using the polymer solution employed in embodiment 1, spinning was conducted under conditions identical to those of embodiment 1, with the exception that a nozzle was employed which had the structure shown in FIG. 4, being provided with a mixing cell in which the polymer flow path 2*c* of the nozzle shown in FIG. 3 projected 1.5 mm from the upper wall of the mixing cell, forming the polymer solution discharge port 2*d* in the center of the mixing cell, and which had a diameter of 2 mmϕ and a length of 13 mm below the discharge part 2*d of the polymer solution.*

The formed product obtained from the polymer solution discharge port showed partially fibrillated fibers; however, the cross-sectional shape of the fibers varied from elliptical to film-shaped.

Figure 17:
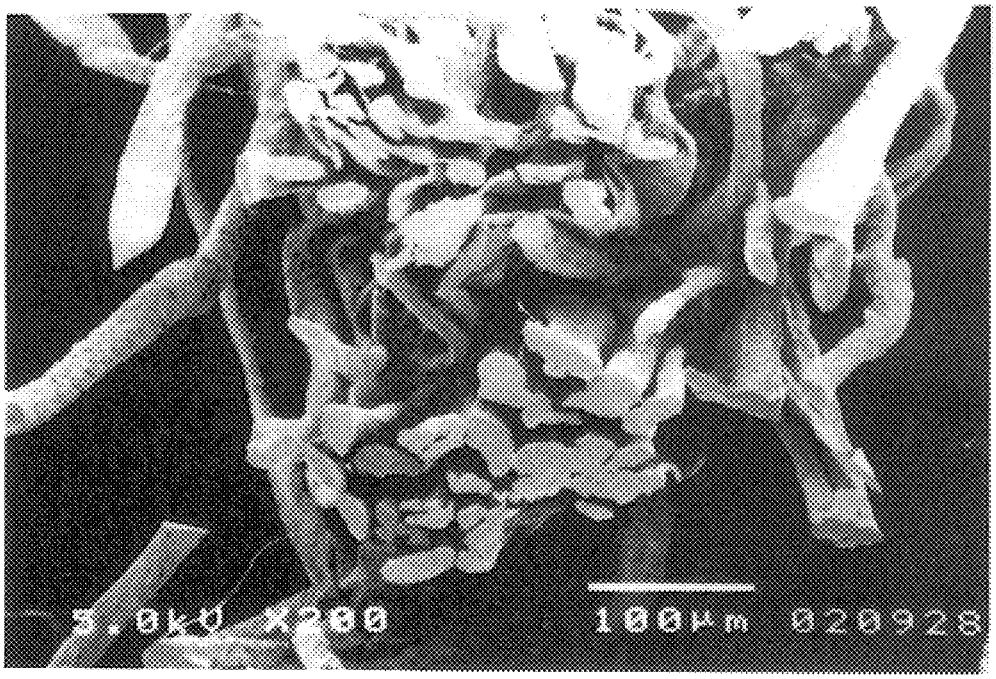
FIG. 17 is an electron micrograph (200 times magnification) of discontinuous fibrillated fibers obtained in embodiment 6.

An electron micrograph of these fibers is shown in FIG. 17.

Comparative Example 1

Figure 5:
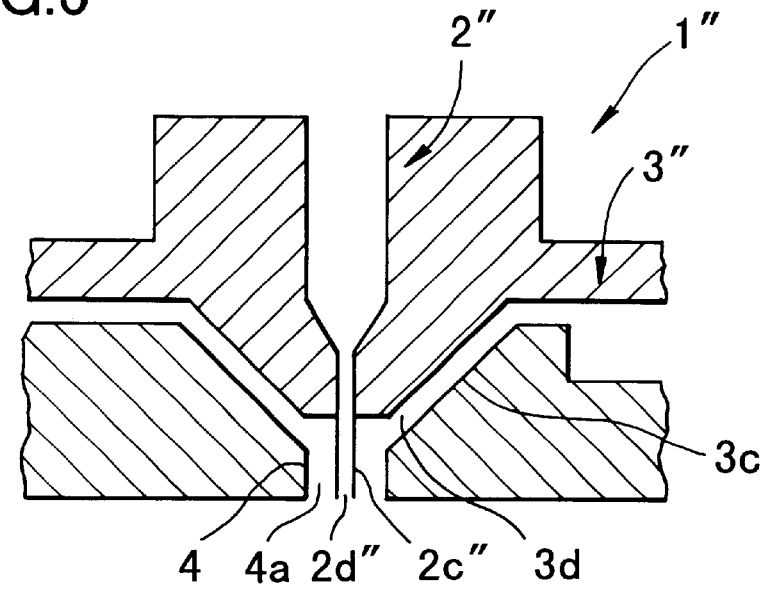
FIG. 5 is a cross-sectional view of a conventional nozzle used in a comparative example.

Using the polymer solution employed in embodiment 1, spinning was conducted under conditions identical to those of embodiment 1, with the exception that a nozzle was employed which had the structure shown in FIG. 5, in which the mixing cell part of the nozzle shown in FIG. 4 was removed.

The product obtained comprised fibers having an elliptical cross section or films and had no branched structure.

Figure 29:
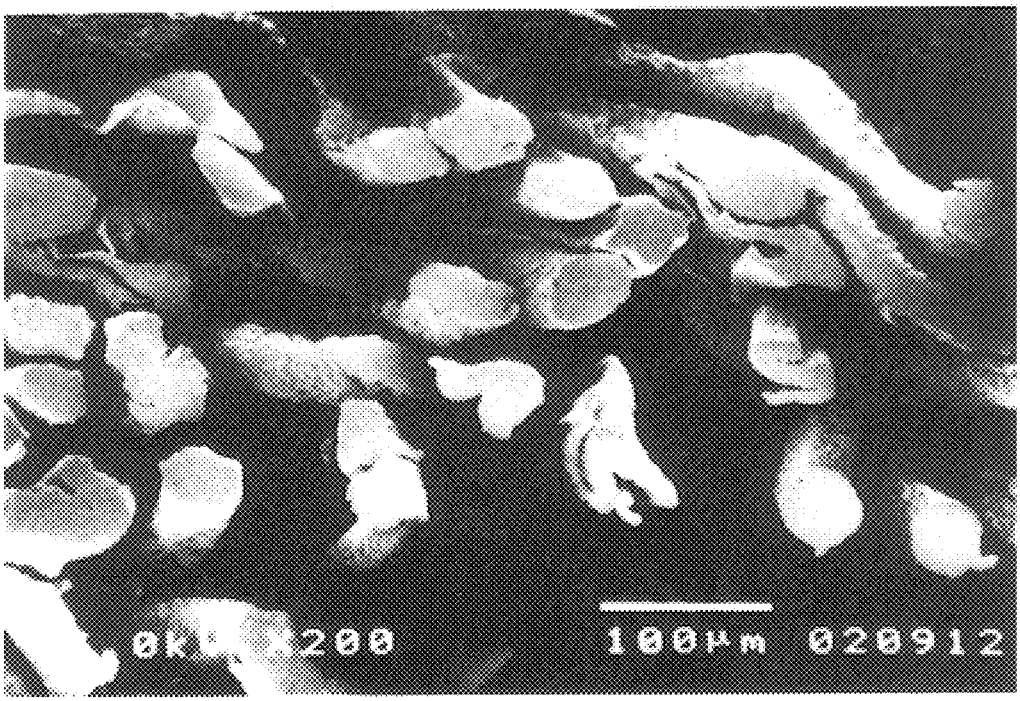
FIG. 29 is an electron micrograph (200 times magnification) of fibers obtained in a comparative example 1.

An electron micrograph of the fibers obtained is shown in FIG. 29.

Embodiment 7

230 g of cellulose diacetate (MBH, produced by Daicel Chemical Industries Ltd.) was dissolved in 770 g of acetone, and a 23 weight percent cellulose diacetate solution in acetone was prepared.

While maintaining the temperature of the solution obtained at 40° C., the solution was extruded under nitrogen pressurization of 1.5 kg/cm$^2$, and using a gear pump, a standard amount of the solution was supplied to the nozzle part depicted in FIG. 3, while water vapor was simultaneously supplied. The control of the amount of water vapor supplied was conducted by controlling the supply pressure using a reducing pressure valve. The amount of water vapor was measured by injecting only water vapor from the nozzle shown in FIG. 3 into the coagulating liquid, and obtaining the increase in weight per unit time.

Using a nozzle in which the solution discharge port had a diameter of 0.2 mmϕ, the mixing cell had a diameter of 2 mmϕ and a length of 1.5 mm and was cylindrical, in which the water vapor flow path had a slit shape with an aperture of 250 micrometers, and in which the angle formed by the central axis of the solution flow path and the central axis of the slit was 60°, the solution of cellulose diacetate in acetone was sprayed into water having a temperature of 30° C. at a supply rate of 18 ml/min, and at a water vapor supply pressure of 1.5 kg/cm$^2$. The amount of water vapor consumed at this time had a water equivalent of 70 g/min, and the linear flow rate of the water vapor within the mixing cell was calculated to be approximately 630 m/sec.

The cellulose diacetate coagulum floating in the coagulating fluid was recovered, this was next washed for a period of one hour in boiling water, and was dried in heated air at a temperature of 80° C.

The form of the surfaces of the fibers in the coagulum obtained was observed using a scanning electron microscope.

Furthermore, using a projection-type stereoscopic microscope (the Profile Projector V-12, produced by Nikon), the form of the fibers in the longitudinal direction was observed. The coagulum obtained was an aggregate of fibrillar and film-shaped material having a thickness within a range of from submicrometers to a few tens of micrometers, and a length within a range of a few tens of micrometers to a few meters; when the length of this coagulum was measured in accordance with JAPAN TAPPI No 52-89, the proportion of fibers having a length greater than 1000 micrometers was found to be 20%, and the fibrils had a branched structure. Furthermore, the specific surface area as measured by the BET method was 9.7 m$^2$/g.

Embodiment 8

A 23 weight percent cellulose diacetate solution in acetone was prepared using a method identical to that of embodiment 7. Formation of the cellulose diacetate was conducted using a method identical to that of embodiment 7, with the exception that the discharge rate of the cellulose diacetate solution was changed to 6 ml/min.

A coagulum having a form identical to that of the coagulum obtained in embodiment 7 was obtained, and the specific surface area of the coagulum was 10.5 m$^2$.

Embodiment 9

A 23 weight percent solution of cellulose diacetate in acetone was prepared by a method identical to that of embodiment 7. Formation of the cellulose diacetate was conducted by a method identical to that of embodiment 7, with the exception that extrusion was conducted from the mixing cell output into a coagulating bath comprising a 30 weight percent solution of acetone in water, at a temperature of 30° C., and a coagulum having a specific surface area of 10.0 $m^2/g$ was obtained.

Embodiment 10

230 g of cellulose diacetate (MBH, produced by Daicel Chemical Industries Ltd.) was dissolved in 770 g of acetone, and a 23 weight percent solution of cellulose diacetate in acetone was prepared.

While maintaining the temperature of the solution obtained at 40° C., the solution was extruded under nitrogen pressurization of 1.5 $kg/cm^2$, and using a gear pump, a standard amount of the solution was supplied to the nozzle part depicted in FIG. 3, while water vapor was simultaneously supplied. The supply rate of the amount of water vapor was controlled by setting the supply pressure using a reducing pressure valve. The amount of water vapor was measured by injecting only water vapor from the nozzle shown in FIG. 3 into the coagulating liquid, and determining the increase in weight per unit time.

Using a nozzle in which the polymer discharge port had a diameter of 0.2 mmϕ, the mixing cell was cylindrical and had a diameter of 2 mmϕ and a length of 1.5 mm, the water vapor flow path had a slit shape and had an aperture of 390 micrometers, and the angle formed by the central axis of the solution flow path and the central axis of the slit was 60°, the solution of cellulose diacetate in acetone was sprayed into water having a temperature of 30° C. at a supply rate of 4.5 ml/min, and at a water vapor supply pressure of 1 $kg/cm^2$. The amount of water vapor consumed at this time had a water equivalent of 73 g/min, and the linear flow rate of the water vapor within the mixing cell was calculated to be approximately 660 m/sec.

The cellulose diacetate coagulum floating in the coagulating fluid was recovered, this was next washed for a period of one hour in boiling water, and was dried in heated air at a temperature of 80° C.

The state of the surfaces of the fibers in the coagulum obtained was observed using a scanning electron microscope.

Furthermore, the state of the fibers in the longitudinal direction was observed using a projection-type stereoscopic microscope (the Profile Projector V-12 produced by Nikon).

The coagulum obtained was an aggregate exhibiting fibrillar and film-shaped materials having a thickness from the submicron level to 10 microns, and a length within a range of a few tens of micrometers to a few meters, and the specific surface area as measured by the BET method was 19.2 $m^2/g$.

Embodiment 11

A 23 weight percent solution of cellulose diacetate in acetone was prepared using a method identical to that of embodiment 10. Formation of the cellulose diacetate was conducted using a method identical to that of embodiment 10, with the exception that the solution was extruded from the mixing cell output into air, and the coagulum was layered on a glass plate and recovered; the specific surface area of the coagulum was found to be 6.7 $m^2/g$.

Embodiments 12-1 through 12-3

The formation of the cellulose diacetate was conducted by a method identical to that of embodiment 10, with the exception that the length of the mixing cell of the nozzle was altered as shown in Table 2. The specific surface areas of the coagula obtained are shown in 2.

When the length of the mixing cell was increased, the coagulum exhibited fibrillar fibers, while on the other hand, when the length of the mixing cell was decreased, film shapes were exhibited; however, the coagula obtained had sufficiently satisfactory specific surface areas.

Embodiment 13

The formation of the cellulose diacetate was conducted by a method identical to that of embodiment 10, with the exception that the length of the mixing cell was set to 104 mm. As shown in Table 2, the specific surface area of the coagulum obtained was satisfactory; however, the cell became periodically clogged.

TABLE 2

| | Embodiment 12-1 | Embodiment 12-2 | Embodiment 12-3 | Embodiment 13 |
|---|---|---|---|---|
| Length of the mixing cell (mm) | 1.5 | 14 | 54 | 104 |
| Specific surface area ($m^2/g$) | 10.7 | 16.5 | 14.9 | 13.4 |

Embodiment 14

The formation of the cellulose diacetate was conducted by a method identical to that of embodiment 10, with the exception that the thickness of the mixing cell was set to 4.0 mmϕ. The amount of water vapor consumed at this time was measured by a method identical to that of embodiment 1, and was found to be 73 g/min, while the linear flow rate of the water within the mixing cell was calculated to be approximately 160 m/sec.

The specific surface area of the coagulum obtained had a satisfactory value, at 13.0 $m^2/g$; however, occasional clogging occurred.

Embodiment 15

133 g of cellulose diacetate (MBH, produced by Daicel Chemical Industries Ltd.) was dissolved in 862 g of acetone, containing 1 weight percent of water, and a 13.3 weight percent solution of cellulose diacetate in acetone was prepared.

Next, while maintaining the temperature of the solution obtained at 40° C., the solution was extruded under a nitrogen pressurization of 1.5 $kg/cm^2$, and using a gear pump, a standard amount of the solution was supplied to the nozzle part depicted in FIG. 3, while water vapor was simultaneously supplied. The supply rate of the amount of water vapor was controlled by setting the supply pressure using a reducing pressure valve. The amount of water vapor was measured by injecting only water vapor from the nozzle shown in FIG. 3 into the coagulating liquid, and obtaining the increase in weight per unit time.

Using a nozzle in which the solution discharge port had a diameter of 0.1 mmϕ, the mixing cell was cylindrical and had a diameter of 2 mmϕ and a length of 14 mm, the water vapor flow path had a slit shape and had an aperture of 390 micrometers, and the angle formed by the central axis of the solution flow path and the central axis of the slit was 60°, the solution of cellulose diacetate in acetone was sprayed into water having a temperature of 30° C. at a supply rate of 19.0 ml/min, and at a water vapor supply pressure of 1.5 kg/cm$^2$. The amount of water vapor consumed at this time had a water equivalent of 87 g/min, and the linear flow rate of the water vapor within the mixing cell was calculated to be approximately 790 m/sec.

The cellulose diacetate coagulum floating in the coagulating liquid was recovered, and was next washed for a period of one hour in boiling water, and was dried in heated air at a temperature of 80° C.

The state of the surfaces of the fibers in the coagulum obtained was observed using a scanning electron microscope.

Furthermore, the state of the fibers in the longitudinal direction was observed using a projection-type stereoscopic microscope (the Profile Projector V-12 produced by Nikon).

The coagulum obtained was an aggregate of fibrillar fibers having a thickness from the submicron level to 10 microns, and a length within a range of a few tens of micrometers to a few hundreds of micrometers; the specific surface area as measured by the BET method was 19.7 m$^2$/g.

Comparative Example 2

While maintaining the temperature of a diacetate acetone solution prepared by a method identical to that of embodiment 7 at 40° C., water vapor was sprayed at a rate of 3.6 g/min from a two-liquid nozzle (Setup No. E25A of Spraying Systems Co.) at a gage pressure of 2.0 kg/cm$^2$, into water at a temperature of 30° C. The fibers obtained were processed in a manner identical to that of embodiment 7, and the state thereof was observed, and a thin film-shaped aggregate was found to result.

Comparative Example 3

Using an acetate acetone solution prepared by a method identical to that of embodiment 7, spinning was conducted by pressurized air at a gage pressure of 2 kg/cm$^2$ in place of the vapor, from the nozzle employed in embodiment 1; however, a lump-shaped polymer was continuously ejected from the mixing cell, and fibrillar fibers could not be obtained.

Comparative Example 4

Figure 6:
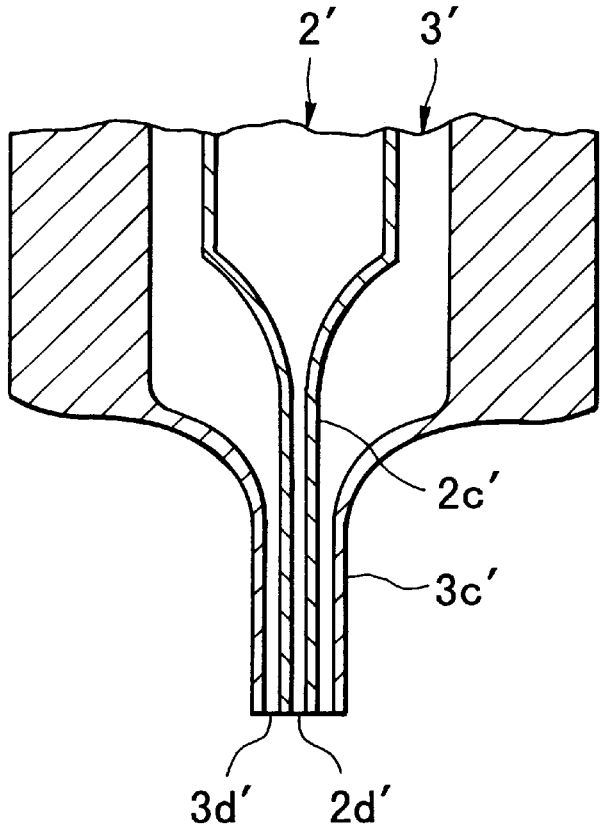
FIG. 6 is a cross-sectional view showing an example of a conventional two-fluid nozzle.

Using an acetate acetone solution prepared in a method identical to that of embodiment 7, and using a two-fluid nozzle such as that shown in FIG. 6 (Setup No. 1A, produced by Spraying System Co.) in place of the nozzle used in embodiment 7, and altering the discharge rate of the solution and water vapor pressure as shown in 3 (experiments 1–5), spraying was conducted into water at 30° C. and cellulose diacetate formation was attempted; however, under all conditions, the nozzle became clogged after a few minutes and stable formation was impossible.

TABLE 3

| Experiment Number | 1 | 2 | 3 | 4 | 5 |
|---|---|---|---|---|---|
| Solution Discharge Rate (ml/min) | 4.5 | 4.5 | 9.0 | 9.0 | 18.0 |
| Water Vapor Pressure (kg/cm$^2$) | 1.0 | 1.5 | 1.5 | 2.0 | 2.0 |

Comparative Example 5

The formation of cellulose diacetate was attempted in a manner identical to that of comparative example 4, with the exception that the two-fluid nozzle was changed to Setup No. 22B produced by the Spraying System Co.; however, as in comparative example 4, the nozzle became clogged after a few minutes, and stable formation was impossible.

Embodiment 16

230 g of cellulose diacetate (MBH, produced by Daicel Chemical Industries Ltd.) was dissolved in 770 g of acetone containing 5 weight percent of water, and a 23 weight percent solution of cellulose diacetate in acetone was prepared.

Next, while maintaining the temperature of the solution obtained at 40° C., the solution was extruded under nitrogen pressurization of 1.5 kg/cm$^2$, and using a gear pump, a standard amount of the solution was supplied to the nozzle part depicted in FIG. 3 and water vapor was simultaneously supplied. The supply rate of the amount of water vapor was controlled by setting the supply pressure using a reducing pressure valve. The amount of water vapor was measured by injecting only water vapor from the nozzle shown in FIG. 3 into the coagulating liquid, and determining the increase in weight per unit time.

Using a nozzle produced so that the solution discharge port had a diameter of 0.2 mmϕ, the mixing cell was cylindrical and had a diameter of 2 mmϕ and a length of 1.5 mm, the water vapor flow path had a slit shape and had an aperture of 250 micrometers, and the angle formed by the central axis of the solution flow path and the central axis of the slit was 30°, the solution of cellulose diacetate in acetone was sprayed into water having a temperature of 30° C. at a supply rate of 18 ml/min, and at a water vapor supply pressure of 1.5 kg/cm$^2$. The amount of water vapor consumed at this time had a water equivalent of 70 g/min, and the linear flow rate of the water vapor within the mixing cell was calculated to be approximately 630 m/sec.

The cellulose diacetate coagulum floating in the coagulating liquid was recovered, this was next washed for a period of one hour in boiling water, and was dried in heated air at a temperature of 80° C.

The state of the surfaces of the fibers in the coagulum obtained was observed using a scanning electron microscope.

Furthermore, the state of the fibers in the longitudinal direction was observed using a projection-type stereoscopic microscope (the Profile Projector V-12 produced by Nikon).

The coagulum obtained was an aggregate exhibiting fibrillar and film-shaped materials having a thickness from the submicron level to a few tens of microns, and a length within a range of a few tens of micrometers to a few meters; when the length of the coagulum was measured in accordance with JAPAN TAPPI No. 52-89, it was determined that the proportion of materials having a length of 1000 micrometers or greater was approximately 20%, and the fibrils had a branched structure. Furthermore, the specific surface area as measured by the BET method was found to be 8.0 m$^2$/g.

Embodiment 17

280 g of cellulose diacetate (MBH, produced by Daicel Chemical Industries Ltd.) was dissolved in 720 g of acetone containing 5 weight percent of water, and a 28 weight percent solution of cellulose diacetate in acetone was prepared.

While maintaining the temperature of the solution obtained at 40° C., the solution was extruded under nitrogen pressurization of 1.5 kg/cm$^2$, and using a gear pump, a standard amount of the solution was supplied to the nozzle part depicted in FIG. 3, while water vapor was simultaneously supplied. The supply rate of the amount of water vapor was controlled by setting the supply pressure using a reducing pressure valve. The amount of water vapor was measured by injecting only water vapor from the nozzle shown in FIG. 3 into the coagulating liquid, and obtaining the increase in weight per unit time.

Figure 30:
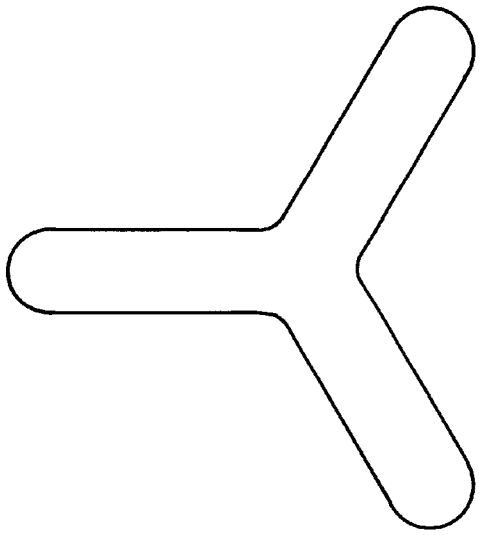
FIG. 30 is a cross-sectional view of the polymer solution discharge port 2*d* of a nozzle employed in embodiments 17 and 40.

Using a nozzle produced so as to have a solution discharge port having a Y-shaped cross section such as that shown in FIG. 30, a cylindrical mixing cell having a diameter of 2 mmϕ, and a length of 1.5 mm, and a water vapor flow path with a slit shape with an aperture of 390 micrometers, where the angle formed by the central axis of the solution flow path and the central axis of the slit was 30°, the solution of cellulose diacetate in acetone was sprayed into water having a temperature of 30° C. at a supply rate of 48.7 ml/min, and at a water vapor supply pressure of 2.5 kg/cm$^2$. The amount of water vapor had a water equivalent of 150 g/min, and the linear flow rate of the water vapor within the mixing cell was calculated to be approximately 1350 m/sec.

The cellulose diacetate coagulum floating in the coagulating fluid was recovered, and postprocessing was conducted by a method identical to that of embodiment 1, desiccation was conducted, and a cellulose diacetate coagulum was obtained.

The state of the surfaces of the fibers in the coagulum obtained was observed using a scanning electron microscope.

Furthermore, the state of the fibers in the longitudinal direction was observed using a projection-type stereoscopic microscope (the Profile Projector V-12 produced by Nikon).

The coagulum obtained was an aggregate of fibrillar and film-shaped materials having a thickness from the submicron level to a few hundreds of microns, and a length within a range of a few tens of micrometers to a few meters; when the length of this coagulum was measured using a method identical to that of embodiment 1, the proportion of materials having a length of 1,000 micrometers or more was found to be approximately 40%, and a branched structure in which the fibrils were branched was present.

Furthermore, the washed coagulum was subjected to a screening test in accordance with JIS P-8207, and the proportion passing through a 150 mesh was found to be 3.9 weight percent.

The specific surface area of the fibers was measured and found to be 6.6 m$^2$/g.

Embodiment 18

Figure 31:
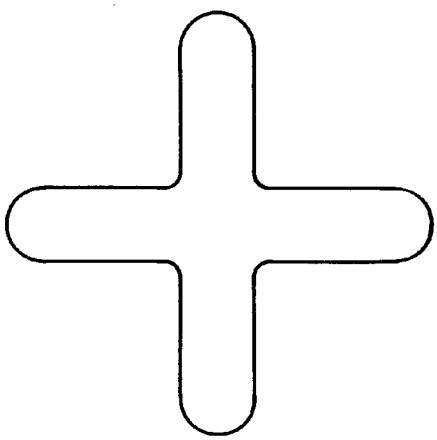
FIG. 31 is a cross-sectional view of a polymer solution discharge port 2*d* of a nozzle employed in embodiment 18.

Using the nozzle depicted in FIG. 3 as in embodiment 17, but wherein the spinning liquid discharge port had a cross-shaped cross section as shown in FIG. 31, spinning was conducted with the same spinning liquid and under the same conditions as in embodiment 17.

The coagulum obtained had a form which was identical to that obtained in embodiment 17, and when a screening test was conducted using a method identical to that of embodiment 17, the proportion passing through a 150 mesh was found to be 9.5 weight percent. Furthermore, the specific surface area was 5.6 m$^2$/g.

Embodiment 19

A base liquid identical to that of embodiment 17 was prepared.

The spinning solution obtained was maintained at a temperature of 40° C., and was extruded under nitrogen pressurization of 1.5 kg/cm$^2$, and using a gear pump, a standard amount was supplied to the nozzle part, while simultaneously supplying water vapor. The amount of water vapor supplied was controlled by setting the supply pressure using a reducing pressure valve. The amount of water vapor was measured by injecting only water vapor from the nozzle shown in FIG. 3 into the coagulating liquid, and obtaining the increase in weight per unit time.

Figure 32:
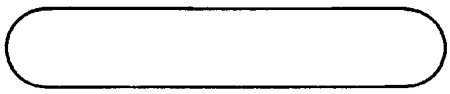
FIG. 32 is a cross-sectional view of a polymer solution discharge port 2*d* of a nozzle employed in embodiment 19.

Using a nozzle produced so that the solution discharge port had a rectangular cross-sectional shape such as that shown in FIG. 32, the mixing cell was cylindrical and had diameter of 2 mmϕ and a length of 1.5 mm, the water vapor flow path had a slit shape with an aperture of 390 micrometers and the angle formed by the central axis of the solution flow path and the central axis of the slit was 30°, the solution of cellulose diacetate in acetone was sprayed into water having a temperature of 30° C. at a supply rate of 18.3 ml/min and at water vapor supply pressure of 2.5 kg/cm$^2$. The amount of water vapor consumed had a water equivalent of 150 g/min, and the linear flow rate of the water vapor within the mixing cell was calculated to be approximately 1350 m/sec.

The cellulose diacetate coagulum floating in the coagulating liquid was recovered, and was subjected to post processing and desiccation by a method identical to that of embodiment 1, and a cellulose diacetate coagulum was obtained.

The state of the surface of the fibers of this coagulum was observed using a scanning electron microscope.

Furthermore, the state of the fibers in the longitudinal direction was observed using a projection-type stereoscopic microscope (the Profile Projector V-12 produced by Nikon).

The coagulum obtained had a form identical to that obtained in embodiment 16, and when a screening test was conducted by a method identical to that of embodiment 16, the proportion passing through a 150 mesh was found to be 6.5 weight percent.

The specific surface area of the fibers was measured and found to be 9.2 m$^2$/g.

Embodiment 20

A 28 weight percent solution of cellulose diacetate in acetone was prepared in a manner identical to that of embodiment 17.

While maintaining the temperature of the solution obtained at 40° C., the solution was extruded under nitrogen pressurization of 1.5 kg/cm$^2$, and using a gear pump, a standard amount was supplied to the nozzle part depicted in FIG. 3, while water vapor was simultaneously supplied. The supply rate of the water vapor was controlled by setting the supply pressure by means of a pressure reducing valve. The amount of water vapor was measured by injecting only water vapor from the nozzle shown in FIG. 3 into the coagulating liquid, and obtaining the increase in weight per unit time.

Using a nozzle produced so that the solution discharge port had a diameter of 0.2 mmϕ, the mixing cell was cylindrical and had a diameter of 2 mmϕ, and a length of 1.5 mm, the water vapor flow path had a slit shape with an aperture of 390 micrometers, where the angle formed by the central axis of the solution flow path and the central axis of the slit was 30°, the solution of cellulose diacetate in acetone was sprayed into water having a temperature of 30° C. at a supply rate of 18 ml/min, and at a water vapor supply pressure of 2.5 kg/cm$^2$. The amount of water vapor consumed had a water equivalent of 145 g/min, and the linear flow rate of the water vapor within the mixing cell was calculated to be approximately 1300 m/sec.

The cellulose diacetate coagulum floating in the coagulating fluid was recovered, and was washed for a period of 1 hour or more in boiling water, and this was then dried in heated air at a temperature of 80°.

The state of the surfaces of the fibers in the coagulum obtained was observed using a scanning electron microscope.

Furthermore, the state of the fibers in the longitudinal direction was observed using a projection-type stereoscopic microscope (the Profile Projector V-12 produced by Nikon), and was found to be identical to that in embodiment 17. When a screening test was conducted in the same manner as in embodiment 17, the proportion passing through a 150 mesh was found to be 6.3 weight percent, so that a good result was obtained; however, the specific surface area was insufficient, at 2.9 m$^2$/g.

Embodiment 21

Pulp dissolved by the sulfite method (having an α-cellulose content of 96.5%) was crushed, and then was desiccated so that the amount of water contained was 5%. 35 parts per weight of glacial acetic acid were added to 100 parts per weight of the pulp containing 5% water, and this was subjected to a pretreatment activation for a period of 30 minutes at 40° C. A mixture of 247 parts per weight of acetic anhydride, placed in a temperature of 40° C. in advance, and 438 parts per weight of glacial acetic acid was prepared in advance in a jacketed glass reaction vessel, and the pretreated activated cellulose was placed therein, and this was agitated and mixed. The pressure within the reaction vessel was reduced to 57 Torr.

A catalyst liquid consisting of 3.8 parts per weight of sulfuric acid set in advance to a temperature of 40° C. and 100 parts per weight of glacial acetic acid was added to the reaction vessel and an acetylation reaction was initiated. This required approximately 20 minutes, and 231 parts per weight of distillate (5% acetic anhydride, the balance comprising acetic acid) was recovered, and the reaction vessel was returned to standard pressures.

The reaction temperature reached 55° C. immediately after the addition of the sulfuric acid catalyst liquid, and after a period of 20 minutes, the temperature was approximately 51° C. 12 minutes after returning the reaction vessel to normal pressure, the reaction temperature reached a peak temperature of 53° C. After this, 16 parts per weight of a 38% aqueous solution of magnesium acetate was added, this was mixed, the sulfuric acid within the system was completely neutralized, and magnesium sulfate was in excess. 71 parts per weight of water at a temperature of 60° C. were then added to this reaction mixture which had been completely neutralized, and this was mixed and agitated. The reaction mixture was then moved to an autoclave, and external heating was applied for a period of 90 minutes to reach a temperature of 150° C. After maintaining the temperature at 150° C. for a period of 30 minutes, this was then slowly cooled and hydrolysis carried out, and secondary cellulose acetate was obtained.

Using the secondary cellulose acetate reaction mixture obtained as a spinning liquid, this was transferred to a jacketed tank maintained at a temperature of 85° C., and extrusion was conducted under nitrogen pressurization of 1.5 kg/cm$^2$, and using a gear pump, a standard amount of the solution was supplied to the nozzle part shown in FIG. 3, while water vapor was simultaneously supplied as a coagulating agent. The amount of water vapor supplied was controlled by setting the supply pressure using a reducing pressure valve. The amount of water vapor was measured by injecting only water vapor from the nozzle shown in FIG. 3 into a coagulating fluid comprising water, and obtaining the increase in the weight per unit time.

Using a nozzle produced so that the solution discharge port had a diameter of 0.2 mmϕ, the mixing cell part was cylindrical and had a diameter of 2 mmϕ, and a length of 1.5 mm, and the water vapor flow path had a slit shape with an aperture of 250 micrometers, and the angle formed by the central axis of the solution flow path and the central axis of the slit was 60°, the cellulose acetate solution was sprayed into water having a temperature of 30° C. at a supply rate of 18 ml/min, and at a water vapor supply pressure of 1.5 kg/cm$^2$. The amount of water vapor consumed had a water equivalent of 70 g/min, and the linear flow rate of the water vapor within the mixing cell was calculated to be approximately 630 m/sec.

The cellulose acetate coagulum floating in the coagulating liquid was recovered, and this was then washed for a period of 1 hour or more in boiling water. The coagulum obtained was filtered, and cellulose acetate fibrillated fibers containing water were obtained. The weight of the solid component of this water-containing material was approximately 27%.

These cellulose acetate fibrillated fibers containing water were t hen again dispersed in water, and an approximately 0.5 weight percent dispersion of fibrils was prepared. This fibril dispersion was diluted and the freeness thereof was measured. The measurement of the freeness was carried out in accordance with JIS P-8121 using a Canadian Freeness Tester. The value after correction to a standard temperature of 20° C. and a standard concentration of 0.30% was 620 ml. Furthermore, a screening test was conducted in accordance with JIS P-8207, and the proportion passing through a 150 mesh was found to be 8.3%.

Next, these water-containing cellulose acetate fibrillated fibers were dried in heated air at a temperature of 80° C., and the state of the side surfaces of the fibers in the coagulum obtained were observed using a scanning electron microscope. Furthermore, the state of the fibers in the longitudinal direction was observed using a projection-type stereoscopic microscope (the Profile Projector V-12 produced by Nikon). The coagulum obtained was found to be an aggregate of fibrillar and film-shaped materials having a thickness from the submicron level to approximately 20 micrometers, and a length within a range of few tens of micrometers to a few millimeters, and the aggregate had portions which exhibited a branching structure, and an overall tree-shaped branching structure was observed.

The specific surface area of the aggregate was measured using an automatic specific surface area measuring device (a Gemini 2375, produced by Micromeritics Instrument Co.), and was found to be 7.2 m$^2$/g.

Embodiment 22

A cellulose acetate reaction liquid was prepared by a method identical to that of embodiment 21 and cellulose acetate formation was conducted using a method identical to that of embodiment 21, with the exception that the discharge rate of the solution was changed to 6 ml/min.

A coagulum having a form identical to that of embodiment 21 was obtained. The specific surface area of the coagulum aggregate was 8.6 m$^2$/g, while the freeness thereof was 590 ml.

Embodiment 23

Coniferous sulfite pulp (having an α-cellulose content of 87%) was crushed, and then was dried so that the amount of water contained was 5%. 500 parts of acetic acid were uniformly distributed in 100 parts per weight of this 5% water-containing pulp, and this was subjected to a pretreatment activation for a period of 90 minutes at 60° C. A mixture of 250 parts per weight of acetic anhydride and 5 parts per weight of sulfuric acid, placed in a temperature of 50° C. in advance, were prepared using a jacketed glass reaction vessel, and the treated activated cellulose was placed therein, and this was agitated and mixed.

After the sulfuric acid catalyst liquid was added, the reaction temperature quickly went to 55° C., and after 20 minutes, the temperature reached 51° C. 12 minutes after the interior of the reaction vessel was returned to normal pressure, the reaction temperature reached a peak of 53° C. After this, 16 parts per weight of a 38% aqueous solution of magnesium acetate was added and mixed, so that the sulfuric acid in the system was completely neutralized, and magnesium sulfate was present in excess. 71 parts per weight of water at a temperature of 60° C. were then added to the completely neutralized reaction mixture, and this was mixed and agitated. The reaction mixture was then mixed and autoclaved, and external heating was applied for a period of 90 minutes to reach a temperature of 150° C. After maintaining the temperature at 150° C. for a period of 30 minutes, slow cooling was conducted and hydrolysis was carried out, to form a secondary cellulose acetate.

The secondary cellulose acetate reaction mixture obtained was used as a spinning liquid, and formation was conducted by a method identical to that of embodiment 21.

Using a nozzle produced so that the solution discharge port had a diameter of 0.2 mmϕ, the mixing cell part was cylindrical and had a diameter of 2 mmϕ, and a length of 1.5 mm, and the water vapor flow path had a slit shape with an aperture of 250 micrometers, where the angle formed by the central axis of the solution flow path and the central axis of the slit was 60°, the cellulose acetate solution was sprayed into water having a temperature of 30° C. at a supply rate of 18 ml/min, and at a water vapor supply pressure of 1.5 kg/cm$^{2.}$ The cellulose acetate coagulum floating in the coagulating liquid comprising water was recovered, and this was then washed for a period of one hour or more using boiling water. The resulting coagulum was filtered, and water-containing cellulose acetate fibrillated fibers were obtained. The solid component weight of this water-containing product was approximately 29%. The cellulose acetate fibrillated fibers obtained were in the form of an aggregate of fibrillar and film-shaped materials having a thickness from the submicron level to 20 micrometers, and a length within a range of a few tens of micrometers to a few millimeters; the aggregate had parts exhibiting a branched structure, and as a whole, a tree-shaped branching structure was observed.

The specific surface area of the coagulum aggregate was 7.6 m$^2$/g, while the freeness thereof was 610 ml.

Embodiment 24

Commercially available ambari hemp writing paper was shredded in a shredder, and chips having a length of approximately 10 mm and a width of approximately 3 mm were obtained. Using these shredded chips as a raw material, the acetylation of the ambari hemp pulp was conducted by means of a process identical to that of embodiment 23. The reaction liquid obtained was used as a spinning liquid, and formation was conducted by means of method identical to that of embodiment 21.

Using a nozzle produced so that the solution discharge port had a diameter of 0.2 mmϕ, the mixing cell part was cylindrical and had a diameter of 2 mmϕ, and a length of 1.5 mm, and the water vapor flow path had a slit shape with an aperture of 250 micrometers, where the angle formed by the central axis of the solution flow path and the central axis of the slit was 60° C., the reaction solution was sprayed into water having a temperature of 30° C. at a supply rate of 18 ml/min, and at a water vapor supply pressure of 1.5 kg/cm$^2$.

The cellulose acetate coagulum floating in the water was recovered, and this was then washed for a period of one hour or more using boiling water. The resulting coagulum was filtered, and water-containing cellulose acetate fibrillated fibers were obtained. The solid component weight of this water-containing material was approximately 27%.

The coagulum obtained comprised an aggregate of fibrillar and film-shaped materials having a thickness from the submicron level to 20 micrometers, and a length within a range of a few tens of micrometers to a few millimeters; the aggregate had parts which exhibited a branched structure, and as a whole, a tree-shaped branched structure was observed.

The specific surface area of the coagulum aggregate was 5.2 m$^2$/g, while the freeness thereof was 650 ml.

Embodiment 25

A linen sheet for paper making (having a thickness of approximately 1 mm) was shredded in a shredder, and chips having a length of approximately 10 mm and a width of approximately 3 mm were obtained. Using these shredded chips as a raw material, the acetylation of the linen pulp was conducted by means of a process identical to that of embodiment 3.

The reaction liquid obtained had a high viscosity, and was difficult to transfer into the jacketed tank, so that the reaction liquid was diluted by the addition of 50 parts per weight of water and 20 parts per weight of acetic acid at 40° C.

This diluted solution was transferred to the tank, and formation was conducted by a method identical to that of embodiment 21.

Using a nozzle produced so that the solution discharge port had a diameter of 0.2 mmϕ, the mixing cell part was cylindrical and had a diameter of 2 mmϕ, and a length of 1.5 mm, and the water vapor flow path had a slit shape with an aperture of 250 micrometers, where the angle formed by the central axis of the solution flow path and the central axis of the slit was 60°, the diluted solution was sprayed into water having a temperature of 30° C. at a supply rate of 18 ml/min, and at a water vapor supply pressure of 1.5 kg/cm$^{2.}$ The cellulose acetate coagulum floating in the water was recovered, and this was then washed for a period of one hour or more using boiling water. The resulting coagulum was filtered, and water-containing cellulose acetate fibrillated fibers were obtained. The solid component weight of this water-containing material was approximately 24%.

The coagulum obtained comprised an aggregate of fibrillar and film-shaped materials having a thickness from the submicron level to 20 micrometers, and a length within a range of a few tens of micrometers to a few millimeters; this aggregate had parts which exhibited a branched structure, and as a whole, a tree-shaped branched structure was observed.

The specific surface area of the coagulum aggregate was 8.7 $m^2/g$, while the freeness thereof was 560 ml.

Embodiment 26

Using ammonium persulfate and sodium sulfite, with water as a medium, as a polymerization catalyst, the polymerization of acrylonitrile was conducted, and after washing and drawing, a 100% weight percent polymer of acrylonitrile with a specific viscosity of 0.18 (measured at 25° C. in a 0.1 g/100 cc DMF solution) was obtained.

200 g of the polymer obtained was dissolved in 800 g of DMF. Using a nozzle identical to that in embodiment 1, this polymer solution was discharged into the mixing cell at a speed of 5.2 ml/min while being maintained at temperature of 80° C. Using vapor as the coagulating fluid, this was sprayed into the mixing cell while maintaining a supply steam pressure of 1.5 $kg/cm^2$. The vapor flow rate was measured in the same manner as in embodiment 1 and was found to be 80 g/min.

The fibers obtained were washed and dried, and the state of the fibers was then observed.

The fibers obtained were in the form of an aggregate having thicknesses from the submicron level to 10 microns, and a lengths within a range of few tens of micrometers to a few hundreds of micrometers.

Embodiment 27

155 g of cellulose diacetate (MBH, produced by Daicel Chemical Industries Ltd.), 75 g of cellulose (dissolving pulp V-60 produced by P & G Cellulose), 2000 g of N-methylmorpholine-N-oxide containing approximately 41 weight percent of water (produced by Sun Technochemical Co. Ltd.), and 15 g of propyl gallate were placed in a mixer provided with a vacuum defoaming device (ACM-5) produced by Kodaira Seisakusyo Co. Ltd., and 670 g of water were removed therefrom while mixing for a period of two hours under reduced pressure heating, and a uniform solution of cellulose acetate/cellulose was prepared. The oven temperature during dissolution was maintained at 100° C.

While maintaining the solution obtained at 100° C., the solution was extruded under nitrogen pressurization of 1.5 $kg/cm^2$, and using a gear pump, a standard amount thereof was supplied to the nozzle part shown in FIG. 3. The amount of spinning liquid discharged was determined by the rotational speed of the gear pump. Using water vapor as the coagulating agent fluid, the amount of water vapor supplied was controlled by setting the supply pressure using a reducing pressure valve. The amount of water vapor was measured by injecting only water vapor into the water while changing the supply pressure from the nozzle, and obtaining the increase in weight per unit time.

Using a nozzle produced so that spinning liquid discharge port 2*d* had a diameter of 0.2 mm, the mixing cell part 4 had a diameter of 2 mm and a length of 24 mm, the coagulating agent fluid had a slit shape with an aperture of 390 micrometers and the angle formed by the discharge line of the spinning liquid and discharge line of the water vapor was 60°, the spinning liquid was sprayed into water having a temperature of 30° at a supply rate of 4.5 ml/min, and at a water vapor supply pressure of 1.0 $kg/cm^2$. The amount of water vapor consumed had a water equivalent of 73 g/min, and the linear flow rate of the water vapor within the mixing cell was calculated to be approximately 660 m/sec, and the water vapor/polymer ratio was approximately 100.

The fibers floating in the coagulating liquid were recovered, and these were washed for a period of one hour or more in boiling water, and air drying was then conducted at room temperature.

Figure 18:
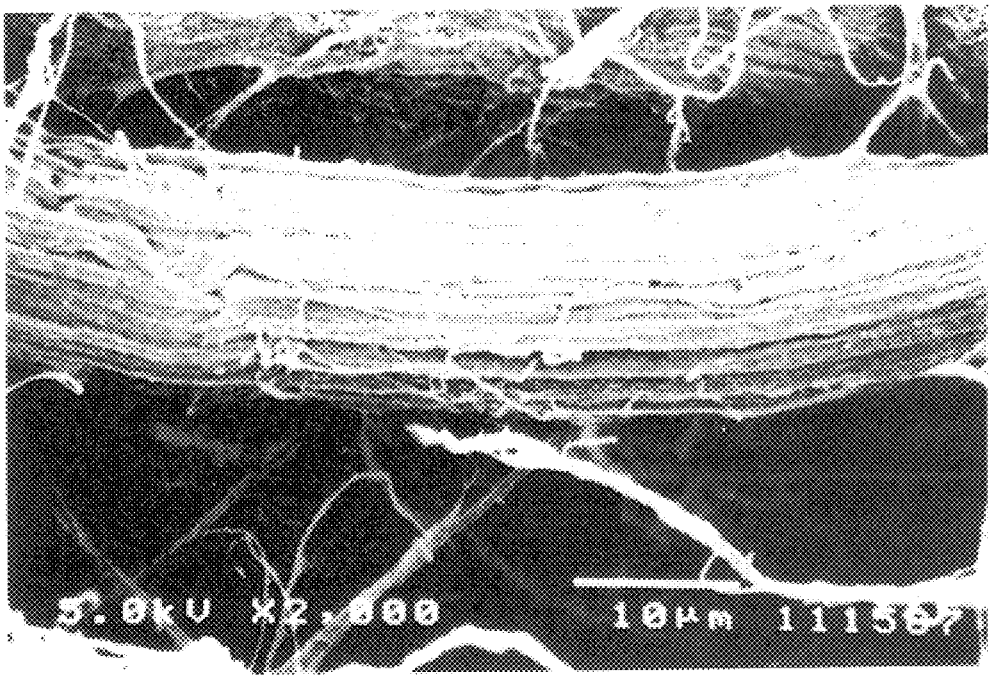
FIG. 18 is an electron micrograph (2000 times magnification) of discontinuous fibrillated fibers obtained in embodiment 27.
Figure 19:
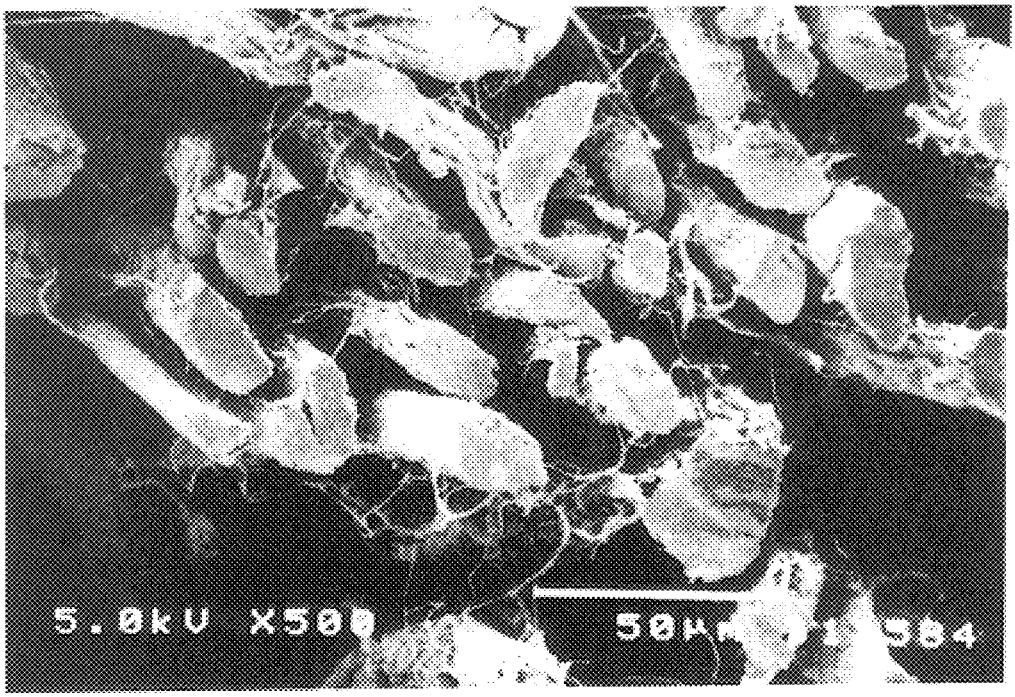
FIG. 19 is an electron micrograph (500 times magnification) of discontinuous fibrillated fibers obtained in embodiment 27.

The state of the cross section and side surfaces of the fibers obtained were observed using a scanning electron microscope. The fibers obtained were surface-fibrillated fibers having a diameter within a range of 1 micrometer–100 micrometers, and a length within a range of 1–10 cm, having a structure in which fibrils having a diameter within a range of 0.1–1 micrometer were layered on the surface of the fibers along the axial direction of the fibers. Electron micrographs of these fibers are shown in FIG. 18 (side surface of the fibers), and FIG. 19 (cross section of the fibers).

Figure 20:
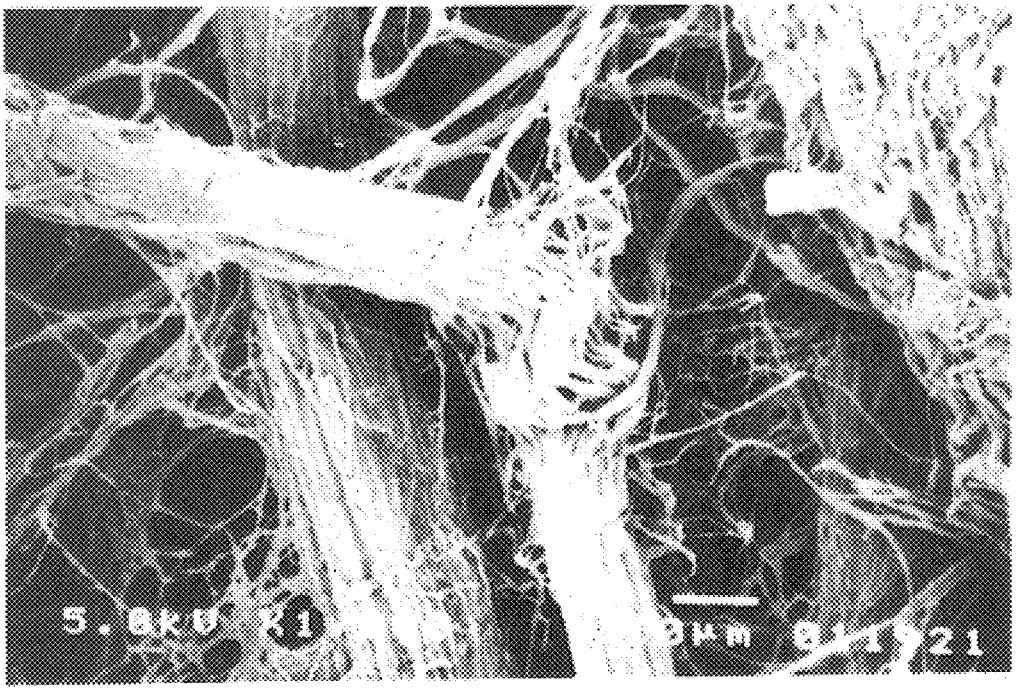
FIG. 20 is an electron micrograph (1000 times magnification) showing another example of a mode of discontinuous fibrillated fibers obtained in embodiment 27.

Using the surface-fibrillated fibers obtained as precursor fibers, these were cut to 5 m/m, and 5 g of these fibers were dispersed in 1 L of water, and beating treatment was carried out for a period of 30 seconds in a kitchen mixer. After beating, the fibers were air dried, and then the state of the side surfaces of the fibers was observed using a scanning electron microscope. A state was observed in which fibrillated fibers having a diameter of 1 micrometer or less branched off from the precursor fibers and curled around one another (the fibril-containing split fibers). The electron micrograph obtained thereof is shown in FIG. 20.

Furthermore, when the beating treatment was continued for a period of 5 minutes, and the fibers obtained thereby were air dried, the side surfaces thereof were observed using a scanning electron microscope. The fibers were found to comprise an aggregate of extremely thin fibers having a diameter of 1 micrometer or less, so that the shape of the precursor fibers almost completely disappeared.

Figure 21:
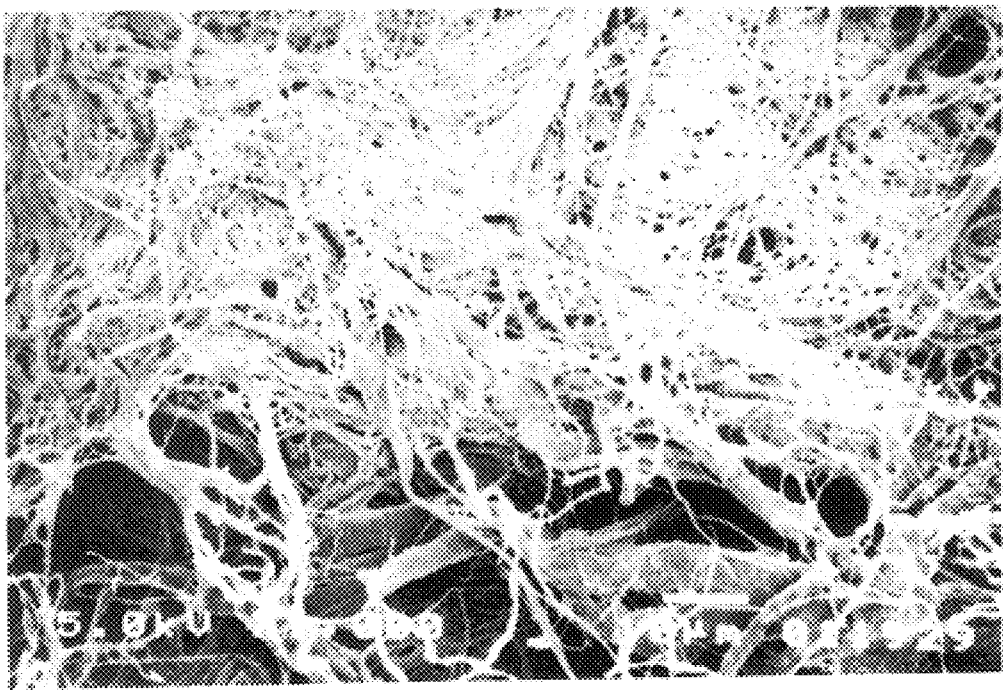
FIG. 21 is an electron micrograph (1000 times magnification) showing another example of a mode of discontinuous fibrillated fibers obtained in embodiment 27.

An electron micrograph thereof is shown in FIG. 21.

Furthermore, when the beating treatment was continued for a total of 20 minutes, and the state of the fibers was observed, a state was observed in which fibrillated fibers having a diameter of 1 micrometer or less were intertwined.

Embodiment 28

230 g of cellulose diacetate (MBH, produced by Daicel Chemical Industries Ltd.), 2000 g of N-methylmorpholine-N-oxide containing approximately 41 weight percent of water, and 15 g of propyl gallate were mixed using a device identical to that of embodiment 9, while removing 700 g of water, thus preparing a cellulose diacetate solution.

Next, the solution obtained was maintained at 90° C., and was extruded under nitrogen pressurization of 1.5 $kg/cm^2$, and using a gear pump, a standard amount of the solution was supplied to a nozzle identical to that in embodiment 9 at a speed of 4.5 ml/min. Furthermore, in the same manner as in embodiment 27, water vapor was employed as the coagulating agent fluid, and this was supplied to the mixing cell while maintaining the pressure at 1.0 $kg/cm^2$ using a reducing pressure valve. The supply rate of the water vapor was measured by a method identical to that of embodiment 27, and was found to be 72 g/min.

Discharge was conducted into a coagulating fluid comprising water, in the same manner as in embodiment 27, and the cellulose diacetate fibers floating therein were recovered, and sufficiently washed and then dried. The fibers obtained were surface-fibrillated fibers, as was the case with the precursor fibers of embodiment 9, in which fibrils having a diameter within a range of 0.1–2 micrometers were layered on the surfaces along the axial direction of the fibers; the length thereof was approximately 1–2 cm.

Figure 22:
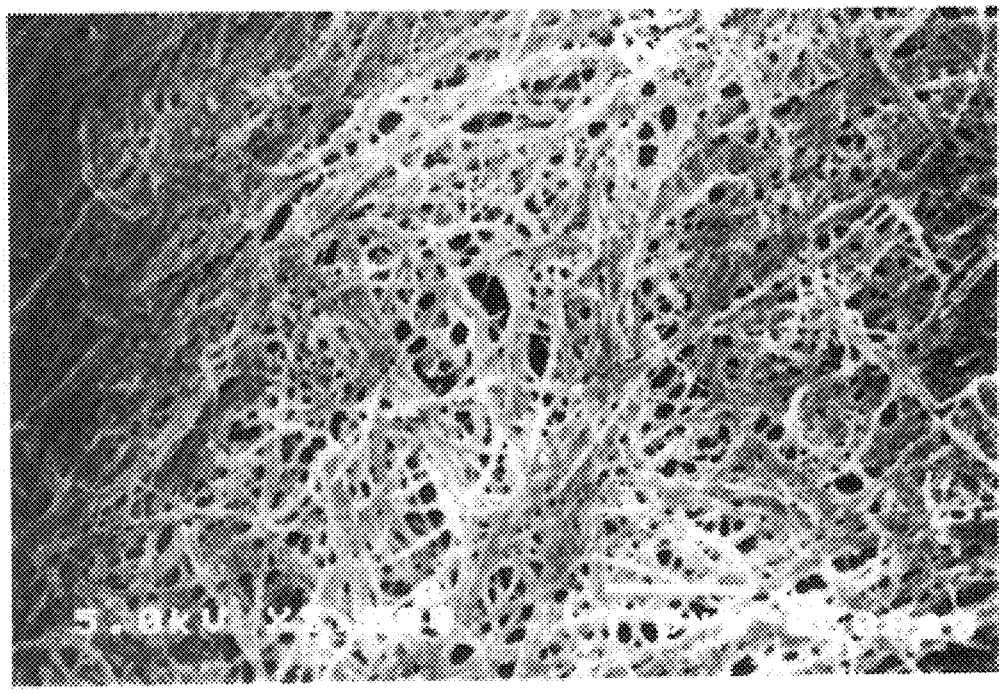
FIG. 22 is an electron micrograph (3500 times magnification) of discontinuous fibrillated fibers obtained in embodiment 28.

The precursor fibers obtained were subjected to beating for a period of 5 minutes by a method identical to that of embodiment 9, and as shown in FIG. 22, almost all the precursor fibers were split by this beating, and this resulted in fibrillated fibers having a diameter of 2 micrometers or less.

Embodiment 29

Using a base liquid prepared by a method identical to that of embodiment 27, the formation of cellulose diacetate/cellulose polymer was conducted by a method identical to that of embodiment 27, with the exception that a nozzle identical to that in embodiment 1 was employed.

The fibers obtained were surface-fibrillated fibers having a structure in which fibrils having a diameter of 0.5 micrometers or less were layered on the surface of the fibers. Using these fibers as precursor fibers, beating was conducted for a period of 5 minutes, by a method identical to that of embodiment 27, and as in embodiment 27, an aggregate of fibrillated fibers resulted in which almost all of the precursor fibers were beaten.

Embodiment 30

Using a base liquid prepared by a method identical to that of embodiment 27, the formation of a cellulose acetate/cellulose polymer was conducted by a method identical to that of embodiment 27, with the exception that the nozzle B of Table 1 was employed.

The fibers obtained were surface-fibrillated fibers having a structure in which fibrils were layered on the surface of the fibers; using these fibers as precursor fibers, beating was conducted for a period of 5 minutes by a method identical to that of embodiment 27, and fibrillated fibers resulting from the beating of the precursor fibers were observed.

Embodiments 31–35

Using a polymer and a solvent identical to that of embodiment 27, solutions were prepared by a method identical to that of embodiment 27 which had differing cellulose diacetate/cellulose component proportions and polymer concentrations, and spinning was conducted by a method identical to that of embodiment 27, and similar treatment was carried out, and precursor fibers of surface-fibrillated fibers were thus obtained.

The polymer proportions and concentration of polymer in the spinning liquid are shown in 4.

As in embodiment 27, the surface-fibrillated fibers obtained in embodiments 31–34 had a structure in which fibrils having a diameter of 1 micrometer or less were layered on the surface of these surface-fibrillated fibers.

As a result of conducting beating for a period of 5 minutes by a method identical to that of embodiment 27, precursor fibers identical to those of embodiment 27 acquired a fibrillar shape with a diameter of 1 micrometer or less as a result of splitting, and a state was observed in which these fibrillated fibers were intertwined.

The surfaces of the precursor fibers obtained in embodiment 35 had parts in which fibrils within a range of 0.1–2 micrometers were layered on the surface along the axial direction, and parts in which a net-shaped material was layered; the precursor fibers were also observed to be in a partially branching state.

When beating of the fibers of embodiment 35 was conducted for a period of 5 minutes using a method identical to that of embodiment 27, a state was observed in which fibrillated fibers splitting from the precursor fibers were intertwined; however, in comparison with embodiment 27, non-split precursor fibers were present in greater amounts.

TABLE 4

| Embodiment Number | 31 | 32 | 33 | 34 | 35 |
|---|---|---|---|---|---|
| Polymer Composition (weight %), cellulose acetate/cellulose | 95/5 | 95/5 | 67/33 | 90/10 | 50/50 |
| Polymer Solution Concentration (weight %) | 15 | 20 | 20 | 20 | 15 |

Embodiment 36

Using ammonium persulfate and sodium sulfite, with water as a medium, as a polymerization catalyst, the polymerization of 115 g of the cellulose diacetate employed in embodiment 27 and acrylonitrile/vinyl acetate in an amount of 93/7 weight percent was carried out, and washing and drying were conducted, and 115 g of the acrylonitrile system polymer having a specific viscosity of 0.17 (measured at 25° C. and in a 0.1 g/100cc DMF solution) which was obtained was dissolved in 770 g of dimethyl acetamide, and a mixed 23 weight percent solution of cellulose diacetate/acrylonitrile system polymer was obtained.

Using a nozzle identical to that in embodiment 27, and employing this mixed solution as a spinning liquid, the spinning liquid was maintained at a temperature of 50° C., and was discharged into the mixing cell at a rate of 9.0 ml/min. Water vapor was employed as the coagulating fluid, and this was sprayed into the mixing cell while maintaining a supply steam pressure of 1.0 kg/cm$^2$. The flow rate of the water vapor was measured by a method identical to that of embodiment 1, and was found to be 75 g/min.

The fibers obtained were washed and dried, and the state of the fibers was then observed.

The fibers obtained had a structure in which the thickness ranged from 1 micrometer to 100 micrometers, and fibrils having a diameter of 2 micrometers or less were layered on the surface of the fibers along the axial direction thereof. The fibers obtained were subjected to beating for 5 minutes using a method identical to that of embodiment 27, and a resulting structure was observed in which fibrils having a diameter of 2 micrometers or less were layered.

Figure 23:
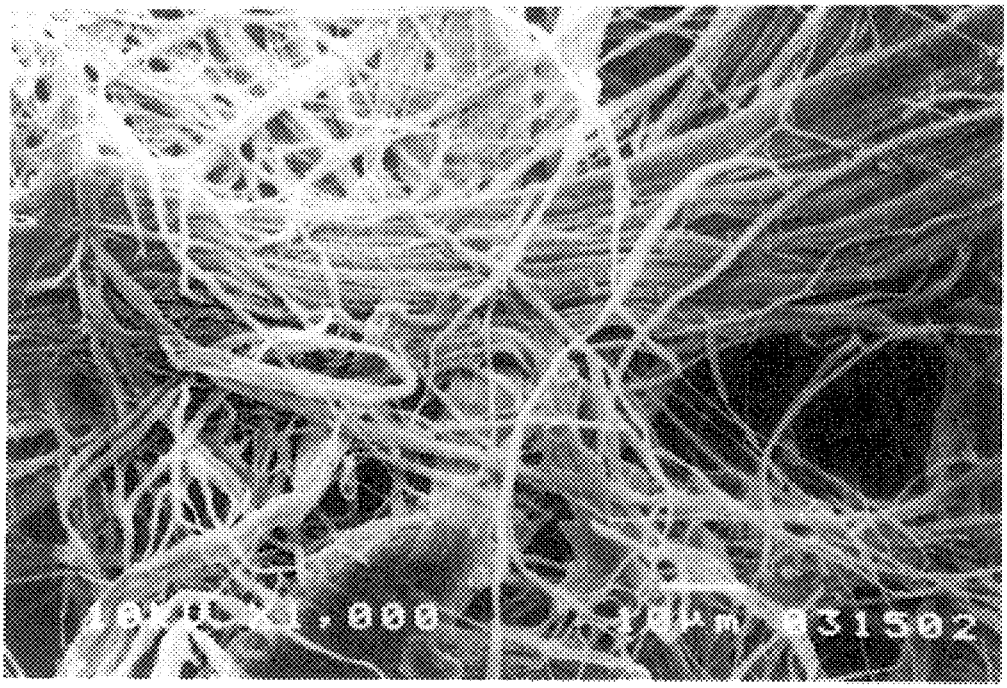
FIG. 23 is an electron micrograph (1000 times magnification) of discontinuous fibrillated fibers obtained in embodiment 36.

The electron micrograph obtained in this case is shown in FIG. 23.

Embodiment 37

Using a solution identical to that of embodiment 36, spinning was conducted under conditions identical to those of embodiment 36, with the exception that the length of the mixing cell part was 1.5 mm.

The fibers obtained were subjected to beating for a period of 5 minutes by a method identical to that of embodiment 27, and these fibers were then observed using a scanning electron microscope, and it was learned that the fibers were essentially identical to those obtained in embodiment 36.

Embodiment 38

Using a solution identical to that of embodiment 36, spinning was conducted using a nozzle having the shape shown in FIG. 4, in which the discharge line of the solution and the spraying line of the coagulating agent were parallel.

In this nozzle, the spinning liquid discharge port **2*d*** had a diameter of 2 mmϕ, the coagulating agent fluid flow path had an aperture of 250 micrometers, the angle formed by the central axis of the spinning fluid and the central axis of the coagulating agent fluid flow path was 60°, and a mixing cell having a length of 0.3 mm was provided.

The temperature of the spinning liquid was maintained at 50° C., as in embodiment 36, and this was discharged into the mixing cell at a rate of 9.0 ml/min. Using water vapor as the coagulating agent fluid, the water vapor was sprayed into the mixing cell while maintaining the supply steam pressure at 1.0 kg/cm$^2$. The flow rate of the water vapor was measured by a method identical to that of embodiment 9, and was found to be 58 g/min. The linear flow rate of the water vapor within the mixing cell was calculated to be approximately 530 m/sec.

Expulsion was conducted into water having a temperature of 30° C., and after washing and drying the fibers obtained, the state of the fibers was observed. The fibers obtained were surface-fibrillated fibers having a thickness within a range of 1 micrometer–100 micrometers, wherein fibrils having a diameter of 2 micrometers or less were layered on the fiber surfaces.

Using the surface-fibrillated fibers obtained as precursor fibers, beating was conducted for a period of 5 minutes by a method identical to that of embodiment 27, and a structure was observed in which fibrils having a diameter of 21 micrometers or less were layered; however, partially non-split precursor fibers were also observed.

Embodiment 39

Using a spinning liquid and nozzle identical to those of embodiment 36, spinning was conducted under conditions identical to those of embodiment 38, with the exception that the discharge rate of the spinning liquid was 18.0 ml/min.

When the fibers obtained were observed, they were found to be fibers identical to those of embodiment 38.

Embodiment 40

The polymerization of 100 weight percent acrylonitrile was conducted, washing and drying were conducted, and 130 g of the resulting acrylonitrile polymer, together with 130 g of polyether sulfone (RADEL A-100, produced by Teijin-Amoco) were dissolved in 740 g of dimethyl formamide, and a 26 weight percent mixed solution of acrylonitrile polymer/polyether sulfone in a 50/50 proportion by weight was obtained.

While maintaining the solution obtained at a temperature of 60° C., extrusion was conducted under a nitrogen pressurization of 1.5 kg/cm$^2$, and a standard amount of solution was supplied to the nozzle part using a gear pump.

The discharge rate of the polymer solution was standardized using the rotational speed of the gear pump. Vapor was used as the coagulating agent fluid, and the supply rate of the vapor was controlled by setting the supply pressure using a reducing pressure valve.

The amount of vapor was measured by injecting only the vapor into water from the nozzle and altering the supply pressure, and obtaining the increase in weight per unit time.

Using a nozzle produced so that the polymer solution discharge port 2*d* had a Y-shaped cross section such as that shown in FIG. 30, the mixed cell part 4 had a diameter of 2 mmϕ and a length of 1.5 mm, the slit aperture of the coagulating agent fluid was 390 micrometers, and the angle formed by the discharge axis of the polymer solution and the discharge axis of the vapor was 30°, the polymer solution was sprayed into water having a temperature of 30° C. at a supply rate of 12.0 ml/min, and at a vapor supply pressure of 1.5 kg/cm$^2$. The amount of vapor consumed had a water equivalent of 70.5 g/min and the linear flow rate of the vapor within the mixing cell was calculated to be approximately 560 m/sec. The fibers floating in the coagulating liquid were recovered, and were then washed for a period of one hour or more in boiling water, and air drying was then conducted at room temperature.

Figure 24:
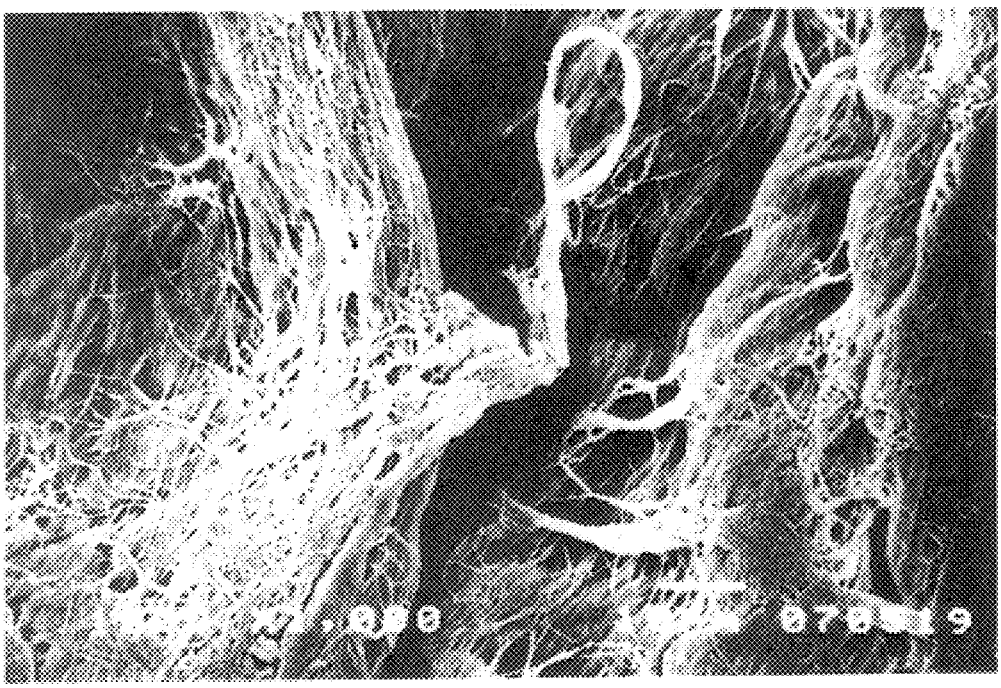
FIG. 24 is an electron micrograph (1000 times magnification) of discontinuous fibrillated fibers obtained in embodiment 40.

The cross section and side surfaces of the fibers obtained were observed using an electron scanning microscope. The fibers obtained were surface-fibrillated fibers having a diameter within a range of 1 micron–100 microns, and a length within a range of 0.1 cm–a few cm, and had a structure in which fibril fibers within a range of 0.1–2 micrometers were layered on the surface of the fibers in the axial direction thereof. An electron scanning micrograph of these fibers is shown in FIG. 24.

The surface-fibrillated fibers obtained were used as precursor fibers, and were cut to 5 mm, and 5 g of these fibers were dispersed in 1 L of water, and these were subjected to beating for a period of 30 seconds in a kitchen mixer. After beating, the fibers were air dried, and then the side surfaces of the fibers were observed using a scanning electron microscope. A state was observed in which a portion of the fibril fibers having a diameter of less than 1 micrometer were separated from the precursor fibers.

Beating was then further continued for a period of 10 minutes, and after the fibers obtained were air dried, the side surfaces thereof were observed using a scanning electron microscope. A state was observed in which a large number of fibril fibers having a diameter of less than 1 micrometer branched from the precursor fibers.

Figure 25:
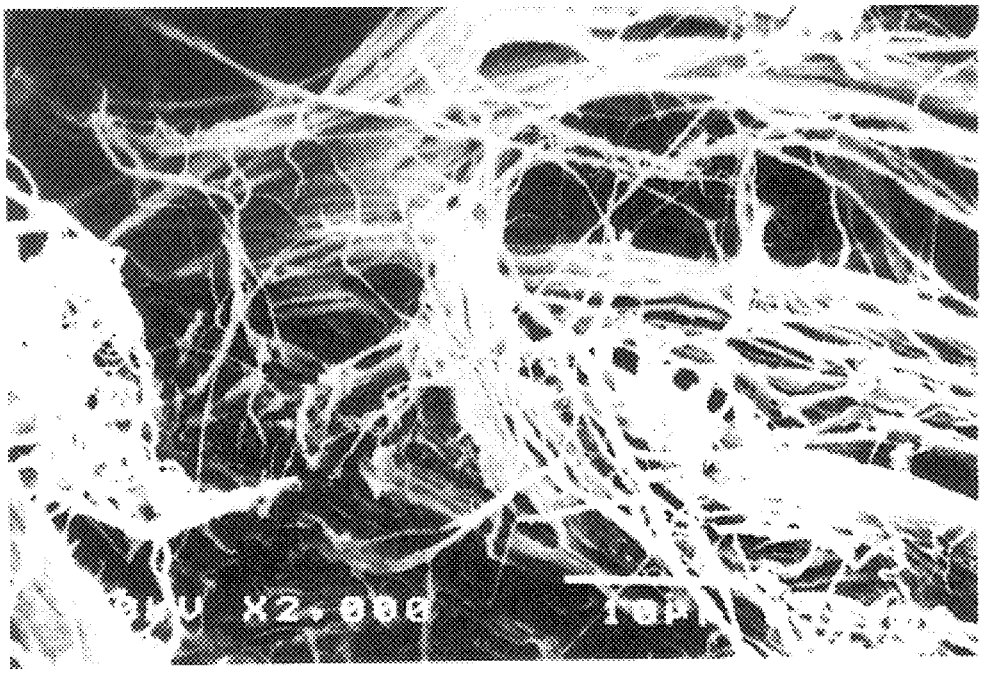
FIG. 25 is an electron micrograph (2000 times magnification) showing another example of a mode of discontinuous fibrillated fibers obtained in embodiment 40.

An electron micrograph thereof is shown in FIG. 25.

Embodiment 41

Using a solution identical to that in embodiment 40, and using a nozzle B produced so that the polymer solution discharge port 2*d* had a diameter of 0.2 mmϕ, the mixing cell part 4 had a diameter of 2 mmϕ and a length of 14 mm, and the angle formed by the discharge axis of the polymer solution and the vapor was 60°, the polymer solution was subjected to spinning under conditions identical to those of embodiment 40, with the exception that the supply rate was 9.0 ml/min.

The fibers obtained were subjected to beating for a period of 10 minutes in a manner identical to that of embodiment 40, and an observation was conducted using a scanning electron microscope; a state was observed in which a large number of fibril fibers having a diameter of less than 1 micrometer branched, as was the case in embodiment 40.

Figure 26:
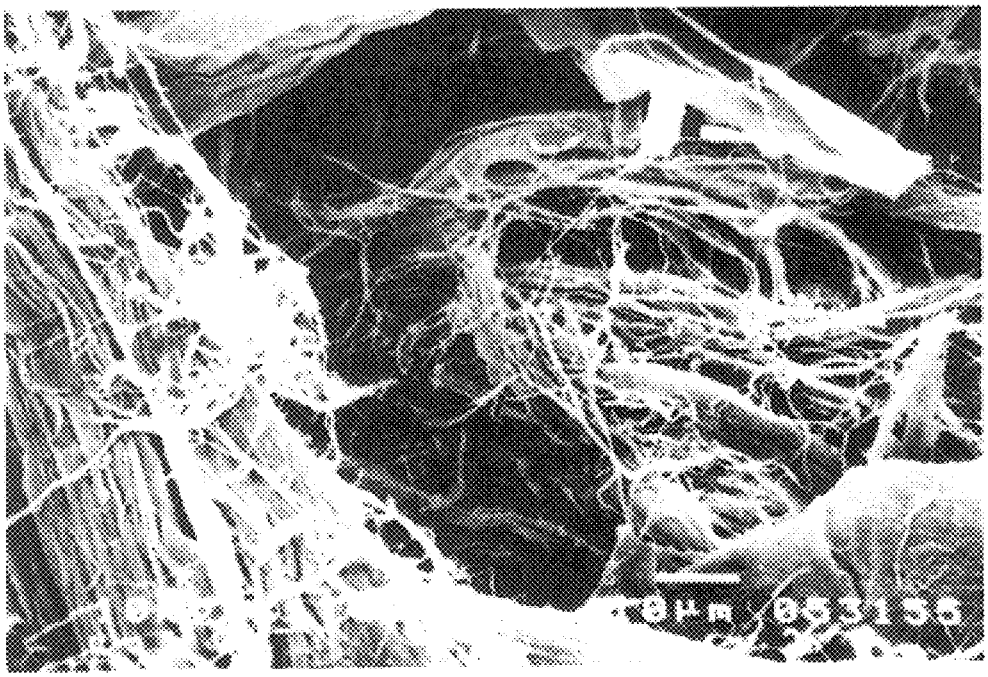
FIG. 26 is an electron micrograph (1000 times magnification) of discontinuous fibrillated fibers obtained in embodiment 41.

An electron micrograph of the fibers obtained is shown in FIG. 26.

Embodiment 42

Using a spinning liquid identical to that of embodiment 40, and using a nozzle identical to that of embodiment 41, with the exception that the length of the mixing cell part was set to 1.5 mm, spinning was conducted under the same conditions.

The fibers obtained were subjected to beating for a period of 10 minutes using a method identical to that of embodiment 40, and when these were observed using a scanning electron microscope, a state was observed in which fibril fibers having a diameter of less than 1 micrometer branched, as was the case in embodiment 41; however, the number of branches was less than in embodiment 41.

Embodiments 43–46

Using a polymer and solvent identical to those in embodiment 40, solutions were prepared having differing acrylonitrile polymer/polyether sulfone component ratios and polymer concentrations using a method identical to that of embodiment 42, and spinning and processing were conducted by a method identical to that of embodiment 42, to produce precursor fibers which were surface-fibrillated fibers.

The polymer proportions and polymer concentrations in the spinning liquid are shown in 5.

As was the case in embodiment 42, the surface-fibrillated fibers obtained in embodiments 43–46 exhibited structures in which fibrils having a diameter of 1 micrometer or less were layered on the surface of the surface-fibrillated fibers.

Beating of these fibers was conducted for a period of 10 minutes using a method identical to that of embodiment 40, and as a result a structure was obtained in which fibrils having a diameter of 1 micrometer or less partially branched from the precursor fibers, as was the case in embodiment 42.

TABLE 5

| Embodiment Number | 43 | 44 | 45 | 46 |
|---|---|---|---|---|
| Polymer Composition (weight %), acrylonitrile polymer/polyether sulfone | 40/60 | 30/70 | 20/80 | 10/90 |
| Polymer Solution Concentration (weight %) | 26 | 26 | 26 | 26 |

Embodiment 47

Figure 27:
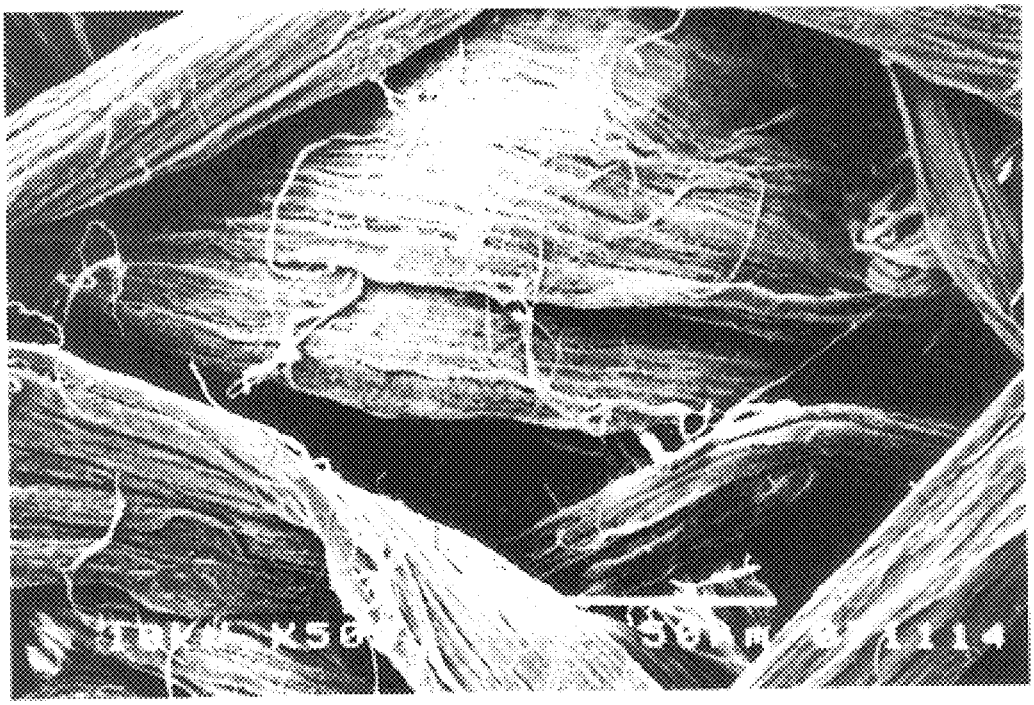
FIG. 27 is an electron micrograph (500 times magnification) of discontinuous fibrillated fibers obtained in embodiment 42.

Polymerization of 93 weight percent of acrylonitrile and 7 weight percent of vinyl acetate was conducted, washing and drying were conducted, and 130 g of the acrylonitrile system copolymer obtained was dissolved, together with 130 g of vinylidene polyfluoride, in 740 g of dimethyl acetamide, and a 26 weight percent mixed solution of acrylonitrile polymer/vinylidene polyfluoride was obtained. The solution obtained was spun under conditions identical to those of embodiment 41. An electron micrograph of the fibers obtained is shown in FIG. 27.

Beating of the fibers obtained was conducted for a period of 10 minutes using a method identical to that of embodiment 40, and the resulting fibers were observed using a scanning electron microscope; a state was observed in which fibrils branched from the precursor in almost the same way as in embodiment 40.

Figure 28:
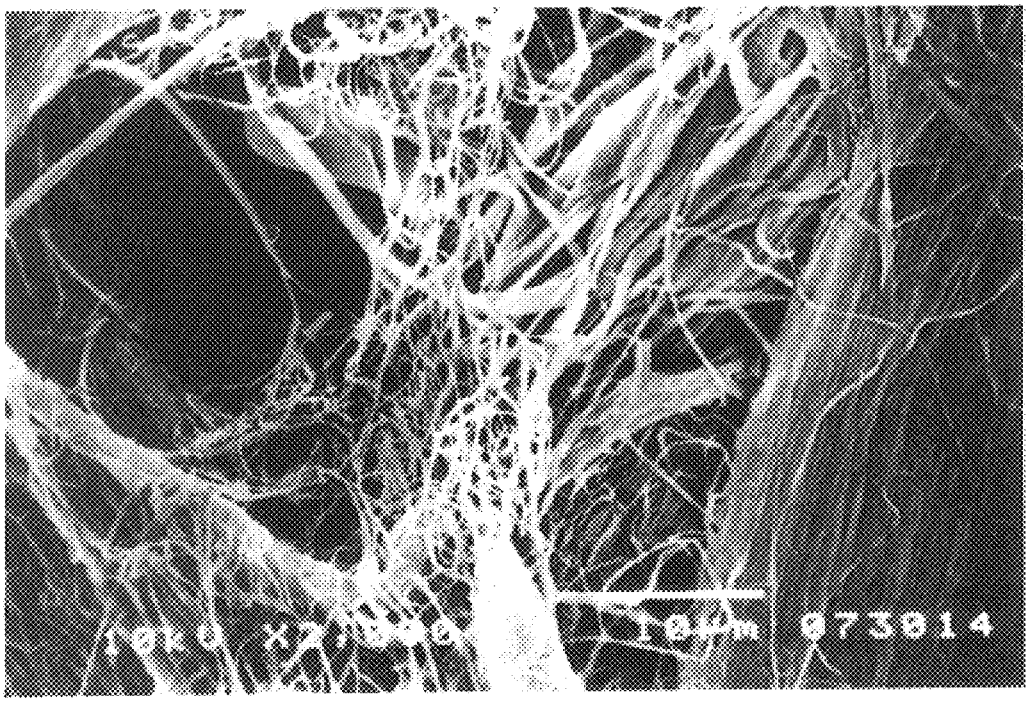
FIG. 28 is an electron micrograph (2000 times magnification) showing anther example of a mode of a discontinuous fibrillated fibers obtained in embodiment 47.

An electron micrograph of the fibers obtained is shown in FIG. 28.

Embodiment 48

Polymerization of 93 weight percent of acrylonitrile and 7 weight percent of acrylamide was conducted, and washing and drying were conducted, and 120 g of the acrylonitrile polymer obtained was dissolved, together with 120 g of poly imide, in 760 g of dimethyl formamide, and a 24 weight percent mixed solution of acrylonitrile system copolymer/polyimide was obtained. The solution obtained was spun under conditions identical to those of embodiment 41.

The fibers obtained were subjected to beating for a period of 10 minutes using a method identical to that of embodiment 40, and the fibers were then observed using a scanning electron microscope; a state was observed in which fibrils branched from the precursor fibers in essentially the same way as in embodiment 41.

Industrial Applicability

Using the present invention, it is possible to efficiently manufacture a fibrillated fiber aggregate from a solution of a polymer having film forming ability, and the fibrillated fibers obtained in this manner, and sheet materials such as non-woven cloths or the like produced from these fibers, may be effectively employed as fibrillated fibers having a high surface area in fields requiring low pressure loss and high filtering ability, such as air filters and the like.

In accordance with the manufacturing method of the present invention, it becomes possible to manufacture highly fibrillated discontinuous fibrillated fibers using a procedure in which the fibrillated fibers described above were processed under low temperatures and low pressures, and furthermore, the production of discontinuous fibrillated fibers from macromolecular polymers having comparatively high glass transition temperatures, which was impossible with conventional technology, or from macromolecular polymers subject to thermal deformation, becomes possible in a stable manner an at low cost, and this can be expected to have a large industrial impact.

Furthermore, the surface-fibrillated fibers of the present invention may be effectively employed in a wide range of fields, such as in the field of raw material fibers for sheet materials such as non-woven cloths or the like which require particularly low pressure loss and a high filtering ability, such as in air filter applications, or as raw material fibers for artificial leather, which have the feel of natural material.

What is claimed is:

1. A manufacturing method for fibril system fibers, wherein a polymer solution, in which a macromolecular polymer having a film forming ability is dissolved in a solvent, is extruded into a mixing cell via a spinneret orifice, and simultaneously, a coagulating agent fluid in a gas chase of the macromolecular polymer is sprayed into the mixing cell so as to flow in the direction of the axis of discharge of the polymer solution, the macromolecular polymer coagulates within the mixing cell in a shear flow, and fibril system fibers are formed, and the fibers are extruded from the mixing cell together with the solvent and the coagulating agent fluid.

2. A manufacturing method for fibril system fibers in accordance with claim 1, wherein, during the discharge of the macromolecular polymer solution having a film forming ability from a spinning discharge port, the coagulating agent of the polymer is sprayed from a coagulating agent fluid spraying port at an angle greater than 0° but less than 90° with respect to the direction of discharge of the spinning liquid, the polymer is coagulated in a shear flow, and the coagulum formed is washed.

3. A manufacturing method for fibril system fibers in accordance with claim 1, wherein a mixed fluid of the fibril system fibers formed, the solvent, and the coagulating agent fluid is discharged into an atmosphere of a coagulating agent in a gas phase or in a liquid phase, regulated by the coagulating agent or a mixed solvent of a solvent and the coagulating agent.

4. A manufacturing method for fibril system fibers in accordance with claim 1, wherein the coagulating agent fluid is a vapor.

5. A manufacturing method for fibril system fibers in accordance with claim 1, wherein the macromolecular polymer having a film forming ability is a polymer containing 30 weight percent or more of cellulose ester, and the solvent is a tertiary amine oxide.

6. A manufacturing method for fibril system fibers in accordance with claim 1, wherein the macromolecular polymer having a film forming ability is cellulose acetate, and acetone is employed as the solvent.

7. A manufacturing method for fibril system fibers in accordance with claim 1, wherein the polymer solution is a cellulose acetate solution prepared by an acetylation reaction by a solvent method using cellulose as a raw material.

8. A manufacturing method for fibril system fibers in accordance with claim 7, wherein an aqueous solution of acetic acid, in which cellulose acetate is dissolved, is employed.

9. A manufacturing method for fibril system fibers in accordance with one of claims 1,2,3 or 4, wherein the macromolecular polymer having a film forming ability is a mixture of two or more polymers: at least one polymer soluble in acrylonitrile system polymer solvent, and acrylonitrile system polymer.

* * * * *